US012709435B2

(12) United States Patent
Minnette et al.

(10) Patent No.: US 12,709,435 B2
(45) Date of Patent: Aug. 18, 2026

(54) FUSION PACKAGING

(71) Applicant: Nypro Inc., Clinton, MA (US)

(72) Inventors: Jeffrey C. Minnette, Clinton, MA (US); Ryan P. Davidson, Clinton, MA (US)

(73) Assignee: Nypro Inc., Clinton, MA (US)

( * ) Notice: Subject to any disclaimer, the term of this patent is extended or adjusted under 35 U.S.C. 154(b) by 52 days.

(21) Appl. No.: 17/911,773

(22) PCT Filed: Mar. 17, 2021

(86) PCT No.: PCT/US2021/022726
§ 371 (c)(1),
(2) Date: Sep. 15, 2022

(87) PCT Pub. No.: WO2021/188646
PCT Pub. Date: Sep. 23, 2021

(65) Prior Publication Data

US 2023/0140599 A1 May 4, 2023

Related U.S. Application Data

(60) Provisional application No. 62/990,551, filed on Mar. 17, 2020.

(51) Int. Cl.
*B65D 17/28* (2006.01)
*B65D 6/00* (2006.01)
(Continued)

(52) U.S. Cl.
CPC ..... *B65D 17/28* (2018.01); *B65D 11/02* (2013.01); *B65D 11/10* (2013.01); *B65D 11/22* (2013.01);
(Continued)

(58) Field of Classification Search
CPC ..... B65D 17/28; B65D 11/02; B65D 11/10; B65D 11/22; B65D 17/12; B65D 25/04;
(Continued)

(56) References Cited

U.S. PATENT DOCUMENTS 3,317,109 A 5/1967 Palmer
4,143,764 A 3/1979 Moss, III
(Continued)

FOREIGN PATENT DOCUMENTS

CN 1787949 A 6/2006
CN 207644989 U 7/2018
(Continued)

OTHER PUBLICATIONS

English Machine Translation of WO-2011092142-A1 (Year: 2011).*
(Continued)

*Primary Examiner* — Laura E. Parker

(57) ABSTRACT

Disclosed herein are fusion packaging and fusion packages. One package includes a frame configured to provide structure for the package, a sidewall fused to the frame, and a tethered cap connected to one end of the frame. Another package includes a sleeve configured to provide structure for the package, a tethered cap fused to one end of the sleeve, and a seal configured to be fused to a remaining end of the sleeve after the package is filled with content. Another package includes a frame configured to provide structure for the package, a film fused to the frame, a cap connected to one end of the frame, the cap including a structure to retain the cap after removal from the frame, and a seal connected to another end of the frame, where one of the cap and seal are connected to the frame after material placement.

21 Claims, 41 Drawing Sheets

(51) Int. Cl.

| | |
|---|---|
| ***B65D 6/34*** | (2006.01) |
| ***B65D 8/00*** | (2006.01) |
| ***B65D 17/00*** | (2006.01) |
| ***B65D 25/04*** | (2006.01) |
| ***B65D 25/36*** | (2006.01) |
| ***B65D 47/08*** | (2006.01) |
| ***B65D 55/16*** | (2006.01) |
| ***B65D 77/20*** | (2006.01) |

(52) U.S. Cl.
CPC ..... *B65D 17/12* (2013.01); *B65D 25/04* (2013.01); *B65D 25/36* (2013.01); *B65D 47/0852* (2013.01); *B65D 55/16* (2013.01); *B65D 77/2032* (2013.01)

(58) Field of Classification Search
CPC .... B65D 25/36; B65D 47/0852; B65D 55/16; B65D 77/2032; B65D 47/0885; B65D 83/08; B65D 47/08; B65D 47/0804
USPC ..... 220/9.1
See application file for complete search history.

(56) References Cited

U.S. PATENT DOCUMENTS

| | | | | |
|---|---|---|---|---|
| 4,219,129 | A * | 8/1980 | Sedgwick | A47K 10/3818 118/43 |
| 4,665,713 | A | 5/1987 | Delatte | |
| 4,905,822 | A | 3/1990 | Bosco | |
| 7,568,590 | B1 * | 8/2009 | Gross | B65D 17/506 220/254.1 |
| D645,754 | S | 9/2011 | Corbett et al. | |
| 8,430,262 | B2 | 4/2013 | Corbett et al. | |
| D692,768 | S | 11/2013 | Corbett et al. | |
| D692,769 | S | 11/2013 | Corbett et al. | |
| D694,635 | S | 12/2013 | Corbett et al. | |
| 8,663,419 | B2 | 3/2014 | Corbett et al. | |
| 8,746,489 | B2 | 6/2014 | Boehler et al. | |
| 8,807,377 | B2 | 8/2014 | Corbett et al. | |
| 8,991,635 | B2 | 3/2015 | Myerscough | |
| 9,126,717 | B2 | 9/2015 | Myerscough | |
| 9,126,719 | B2 | 9/2015 | Corbett et al. | |
| 9,145,251 | B2 | 9/2015 | Minnette et al. | |
| 9,302,832 | B2 | 4/2016 | Park | |
| 9,452,857 | B2 | 9/2016 | Corbett et al. | |
| 9,463,894 | B2 | 10/2016 | Minnette et al. | |
| 9,574,307 | B2 | 2/2017 | Corbett et al. | |
| 9,604,769 | B2 | 3/2017 | Minnette et al. | |
| 9,884,716 | B2 | 2/2018 | Minnette et al. | |
| 10,005,222 | B2 | 6/2018 | Corbett et al. | |
| 10,005,605 | B2 | 6/2018 | Corbett et al. | |
| 10,532,872 | B2 | 1/2020 | Minnette et al. | |
| 11,167,904 | B2 | 11/2021 | Corbett et al. | |
| 11,286,104 | B2 | 3/2022 | Corbett et al. | |
| 11,383,887 | B2 | 7/2022 | Corbett et al. | |
| 2003/0218017 | A1 | 11/2003 | Schmidtner et al. | |
| 2004/0159684 | A1 * | 8/2004 | Roberts | B65D 47/2006 222/556 |
| 2006/0011635 | A1 * | 1/2006 | Shibata | B65D 3/30 220/485 |
| 2007/0095832 | A1 * | 5/2007 | Hollis | B65D 47/0847 220/780 |
| 2007/0164095 | A1 * | 7/2007 | Schuetz | B65B 7/2878 229/125.05 |
| 2008/0110920 | A1 * | 5/2008 | Hlista | B65D 83/0841 221/45 |
| 2008/0169297 | A1 * | 7/2008 | Kelly | A47J 41/0077 220/592.16 |
| 2010/0108693 | A1 | 5/2010 | Zhang et al. | |
| 2010/0140129 | A1 | 6/2010 | Sanfilippo et al. | |
| 2011/0290798 | A1 | 12/2011 | Corbett et al. | |
| 2012/0012586 | A1 * | 1/2012 | Rinderer | B65D 17/4014 220/269 |
| 2012/0024897 | A1 | 2/2012 | Corbett et al. | |
| 2012/0145710 | A1 | 6/2012 | Corbett et al. | |
| 2013/0001233 | A1 * | 1/2013 | Hylton | A47G 19/2272 220/592.2 |
| 2014/0252032 | A1 | 9/2014 | Corbett et al. | |
| 2014/0353202 | A1 * | 12/2014 | Park | B65D 15/08 206/524.6 |
| 2014/0367296 | A1 | 12/2014 | Berger et al. | |
| 2015/0314916 | A1 | 11/2015 | Corbett et al. | |
| 2016/0000269 | A1 * | 1/2016 | Van Puijenbroek | B65D 51/18 53/421 |
| 2016/0159530 | A1 * | 6/2016 | Minnette | B65D 3/30 220/604 |
| 2016/0159545 | A1 | 6/2016 | Corbett et al. | |
| 2017/0240326 | A1 * | 8/2017 | Rognard | B65D 47/0804 |
| 2018/0022534 | A1 | 1/2018 | McCormick | |
| 2018/0127161 | A1 * | 5/2018 | Smith | A47G 19/2272 |
| 2019/0135479 | A1 | 5/2019 | Corbett et al. | |
| 2019/0161236 | A1 | 5/2019 | Knob et al. | |
| 2021/0039841 | A1 * | 2/2021 | Pucci | B65D 51/248 |
| 2021/0284418 | A1 | 9/2021 | Corbett et al. | |
| 2022/0048669 | A1 | 2/2022 | Minnette et al. | |
| 2022/0169437 | A1 | 6/2022 | Corbett et al. | |
| 2022/0340335 | A1 | 10/2022 | Corbett et al. | |
| 2023/0054953 | A1 | 2/2023 | Graham et al. | |
| 2023/0055756 | A1 | 2/2023 | Brown | |
| 2023/0331449 | A1 | 10/2023 | Graham et al. | |
| 2023/0371675 | A1 | 11/2023 | Graham et al. | |

FOREIGN PATENT DOCUMENTS

| | | | | |
|---|---|---|---|---|
| CN | 211443376 | U | 9/2020 | |
| CN | 112020466 | A | 12/2020 | |
| DE | 8434358 | U1 | 2/1985 | |
| EP | 2236264 | A1 | 10/2010 | |
| EP | 3511263 | A1 | 7/2019 | |
| FR | 2289394 | A1 | 5/1976 | |
| GB | 2510643 | A * | 6/2014 | B65D 1/38 |
| JP | H10-058482 | A | 3/1998 | |
| JP | 2013534496 | A | 9/2013 | |
| WO | WO-2008134174 | A1 * | 11/2008 | B65D 15/04 |
| WO | WO-2011092142 | A1 * | 8/2011 | B29C 45/82 |
| WO | 2014031869 | A1 | 2/2014 | |
| WO | 2014125385 | A1 | 8/2014 | |
| WO | 2014193608 | A1 | 12/2014 | |
| WO | 2022055921 | A1 | 3/2022 | |

OTHER PUBLICATIONS

Notice of Allowance issued in corresponding U.S. Appl. No. 17/412,837, dated Apr. 22, 2024.
Office Action with English translation issued in corresponding CN Application No. 202280056814.X, dated Sep. 3, 2025.

* cited by examiner

FUSION PACKAGING

CROSS-REFERENCE TO RELATED APPLICATION(S)

This application is a national stage entry of International Patent Application Serial No. PCT/US2021/022726, filed Mar. 17, 2021, which claims priority to U.S. Provisional Application Ser. No. 62/990,551, filed Mar. 17, 2020, the entire disclosures of which are incorporated herein.

TECHNICAL FIELD

This disclosure relates to packaging and in particular, packages having rigid and flexible components which are fused or bonded together.

BACKGROUND

Pouches or structureless packages commonly used for snacks, chips, yogurt, liquids, and the like have numerous issues or disadvantages. These types of packages are generally not recyclable. They are unable to go through the grinding, cleaning, bleaching, and other processing to produce recycled materials. Contents in these types of packages are subject to increased breakage. Shipping is inefficient due to inability to stack these types of packages. Presentation or display of the packages on store shelves result in similar issues.

SUMMARY

Disclosed herein are methods and systems for fusion packaging.

In implementations, a package includes a frame configured to provide structure for the package, a sidewall fused to the frame, and a tethered cap connected to one end of the frame. In implementations, the frame includes a retainment locking element for retaining a retaining element of the tethered cap and the tethered cap includes a tether mechanism connected to the retaining element. In implementations, the tethered cap includes a tab element configured to enable access to content in the package, a tearable membrane portion configured to be peeled away by the tab element to expose an opening to access the content, a tether mechanism configured to connect the tearable membrane portion to a remaining portion of the tethered cap, and a tab element retainer configured to retain the tab element away from the opening. In implementations, the tethered cap includes a tab element configured to enable access to content in the package, wherein the tab element is configured to partly fuse with an outer surface of the sidewall, a peelable portion configured to be peeled away by the tab element to expose an opening to access the content, and a tether mechanism configured to connect the peelable portion to a remaining portion of the tethered cap. In implementations, the frame includes a rim having a narrow section and a wide section, the tether mechanism configured to be fused to the wide section. In implementations, the tethered cap is configured to be pivotable between an open position and a closed position, wherein the tethered cap includes an opening configured to dispense content when the tethered cap is in the open position. In implementations, the tethered cap includes pins configured to engage pin openings on the frame to go from an open position to a close position and a partially openable seal including a perforated portion configured to allow access to content when the perforated portion is removed and the tethered cap is in the open position, the partially openable seal configured to be fused to the frame, where the tethered cap can be placed in a closed position after accessing the content. In implementations, the frame includes a content holding and guiding structure positioned below the perforated portion, the content holding and guiding structure configured to present the content to a user for removal from the package. In implementations, the package further including a divider structure configured to establish two compartments in the package. The divider structure including an access divider configured to provide access to each compartment, where the access divider is connected to a neck of the frame; and a compartment divider configured to divide the frame into the two compartments, wherein the compartment divider is connected to diagonally opposite legs of the frame. In implementations, the divider structure and the injection molded frame are integrated. In implementations, the package further including a seal configured to be fused with another end of the frame, where one of the tethered seal and the seal is fused after filling the package with content.

In implementations, a package includes a sleeve configured to provide structure for the package, a tethered cap fused to one end of the sleeve, and a seal configured to be fused to a remaining end of the sleeve after the package is filled with content. In implementations, the tethered cap includes a peelable portion configured to provide an opening for access to the content in the package, the peelable portion including a retain groove, and a tethered portion fused to the sleeve and connected to the peelable portion by a hinge portion, the tethered portion including a retain projection, where the retain projection and the retain groove lock the peelable portion away from the opening during access to the content.

In implementations, a package includes a frame configured to provide structure for the package, a film fused to the frame, a cap connected to one end of the frame, the cap including a structure to retain the cap after removal from the frame, and a seal connected to another end of the frame, where one of the cap and seal are connected to the frame after material placement. In implementations, the cap further includes a peel portion, a retain portion, and a hinge portion configured to connect the peel portion and the retain portion, where the peel portion is retained to the retain portion after peeling the peel portion away from the package. In implementations, the peel portion can be configured to be detached from the retain portion.

In implementations, a package includes a frame configured to provide structure for the package, the frame including an integrated cap, a film fused to the frame, and a seal connected to one end of the frame after material placement. In implementations, where the integrated cap includes a structure to retain a portion of the integrated cap after removal from the frame. In implementations, where the portion of the integrated cap can be configured to be detached from the integrated cap. In implementations, where a peelable portion of the integrated cap can be configured to be detached from the integrated cap. In implementations, where the integrated cap further includes a peel portion, a retain portion, and a hinge portion configured to connect the peel portion and the retain portion, wherein the peel portion is retained to the retain portion after peeling the peel portion away from the package. In implementations, where the peel portion can be configured to be detached from the hinge portion.

In implementations, a package includes a sleeve configured to provide structure for the package, a cap portion fused to one end of the sleeve, the cap portion including a peel portion, a retain portion, and a hinge portion configured to connect the peel portion and the retain portion, wherein the peel portion is retained to the retain portion after peeling the peel portion from the cap portion, and a seal configured to be fused to a remaining end of the sleeve after the package is filled with content. In implementations, where the peel portion includes a retain element and the retain portion includes a mated retain element configured to maintain the peel portion away from an opening created when peeling the peel portion away from the cap portion. In implementations, where the peel portion can be configured to be detached from the hinge portion.

BRIEF DESCRIPTION OF THE DRAWINGS

The disclosure is best understood from the following detailed description when read in conjunction with the accompanying drawings and are incorporated into and thus constitute a part of this specification. It is emphasized that, according to common practice, the various features of the drawings are not to-scale. On the contrary, the dimensions of the various features are arbitrarily expanded or reduced for clarity.

DETAILED DESCRIPTION

Figure 1B:
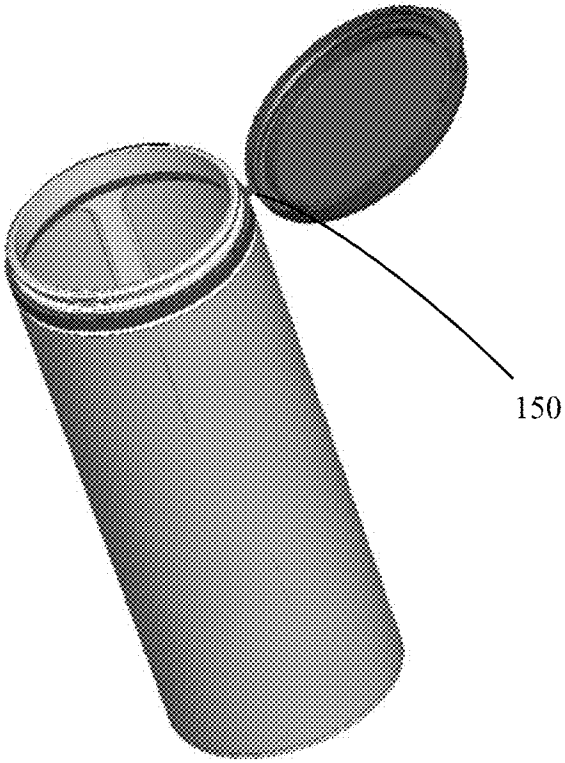
FIG. 1A and FIG. 1B are diagrams of a fusion package in a closed position and an open position, respectively, in accordance with implementations.

The figures and descriptions provided herein may be simplified to illustrate aspects of the described embodiments that are relevant for a clear understanding of the herein disclosed processes, machines, manufactures, and/or compositions of matter, while eliminating for the purpose of clarity other aspects that may be found in typical similar devices, systems, compositions and methods. Those of ordinary skill may thus recognize that other elements and/or steps may be desirable or necessary to implement the devices, systems, compositions and methods described herein. However, because such elements and steps are well known in the art, and because they do not facilitate a better understanding of the disclosed embodiments, a discussion of such elements and steps may not be provided herein. However, the present disclosure is deemed to inherently include all such elements, variations, and modifications to the described aspects that would be known to those of ordinary skill in the pertinent art in light of the discussion herein.

Embodiments are provided throughout so that this disclosure is sufficiently thorough and fully conveys the scope of the disclosed embodiments to those who are skilled in the art. Numerous specific details are set forth, such as examples of specific aspects, devices, and methods, to provide a thorough understanding of embodiments of the present disclosure. Nevertheless, it will be apparent to those skilled in the art that certain specific disclosed details need not be employed, and that embodiments may be embodied in different forms. As such, the exemplary embodiments set forth should not be construed to limit the scope of the disclosure.

The terminology used herein is for the purpose of describing particular embodiments only and is not intended to be limiting. For example, as used herein, the singular forms "a", "an" and "the" may be intended to include the plural forms as well, unless the context clearly indicates otherwise. The terms "comprises," "comprising," "including," and "having," are inclusive and therefore specify the presence of stated features, steps, operations, elements, and/or components, but do not preclude the presence or addition of one or more other features, steps, operations, elements, components, and/or groups thereof.

The steps, processes, and operations described herein are thus not to be construed as necessarily requiring their respective performance in the particular order discussed or illustrated, unless specifically identified as a preferred or required order of performance. It is also to be understood that additional or alternative steps may be employed, in place of or in conjunction with the disclosed aspects.

Yet further, although the terms first, second, third, etc. may be used herein to describe various elements, steps or aspects, these elements, steps or aspects should not be limited by these terms. These terms may be only used to distinguish one element or aspect from another. Thus, terms such as "first," "second," and other numerical terms when used herein do not imply a sequence or order unless clearly indicated by the context. Thus, a first element, step, component, region, layer or section discussed below could be termed a second element, step, component, region, layer or section without departing from the teachings of the disclosure.

The non-limiting embodiments described herein are with respect to fusion packages. The fusion packages and methods for making the fusion packages may be modified for a variety of applications and uses while remaining within the spirit and scope of the claims. The embodiments and variations described herein, and/or shown in the drawings, are presented by way of example only and are not limiting as to the scope and spirit. The descriptions herein may be applicable to all embodiments of the fusion packages and the methods for making the fusion packages.

Disclosed herein are implementations of fusion packaging. The implementations shown are illustrative and other implementations are within the scope of the specification and claims described herein. For purposes of illustration, certain aspects, features, and the like are described with respect to implementations. These aspects, features, and the like are appropriately applicable to and interchangeable with other implementations described herein.

In implementations, the fusion packages described herein provide structure to the packaging by using a combination of injection molding (IM), in-mold labeling (IML), die cutting, compression blow molding, thermoform molding, and the like processing (collectively "structure forming process") to form a frame, ribbed frame, vertical frame, cap, neck or collar structure, and the like (collectively "structure") with injection molding (IM), in-mold labeling (IML), heat, induction, mechanical, staking, ultrasonic, and adhesive or chemical bonding (collectively "join processing") to fuse, weld, or bond (collectively "fuse") the structure with a flexible part to create a sealed package which can hold content or materials. In implementations, the fusing can include application of pressure, temperature, and/or combinations thereof. In implementations, the sealed package is an integrally, hermetically sealed package. In implementations, the sealed package can be configured to contain liquid or non-dry content or materials.

In implementations, the frame, ribbed frame, vertical frame (collectively "frame") can have a rectangular, square, oval, circular, and/or like profile or footprint. In implementations, the frame can have any number of legs or ribs connecting a base portion and a neck portion. In implementations, the structure can be made from polymers, sustainable materials, recyclable materials, biodegradable materials, bio-based resins, weight-optimized biodegradable plastic, and the like.

In implementations, the flexible part can be or can be made from heavy film, paperboard, pressed pulp, and the like. In implementations, the flexible part can include a barrier layer or film on an internal or inside surface, where the barrier layer is impervious to the content or material in the fusion package and chemically inert with respect to the content or material in the fusion package. In implementations, the flexible part can be an integrated or integrally formed barrier layer or film with the heavy film, paperboard, pressed pulp, and the like. In implementations, the flexible part can be or can be made from recyclable, sustainable, degradable, biodegradable, and like materials.

In implementations, the fusion packages and/or the components of the fusion packages can be of paper, fiber based, pressed fiber, and/or plastic construction, which can be sustainable materials, recyclable materials, degradable materials, degradable plastic, biodegradable materials, bio-based resins, and/or weight-optimized biodegradable plastic. The fusion packages and/or the components of the fusion packages can efficiently use recyclable, biodegradable, and the like materials for improved sustainability.

In implementations, the fusion packages described herein provide structure to the packaging by fusing a neck part to a tubular or conical sleeve. In implementations, the sleeve can be or can be made from heavy film, paperboard, pressed pulp, and the like. In implementations, the sleeve can include a barrier layer or film on an internal or inside surface. In implementations, the sleeve can be an integrated or integrally formed barrier layer or film with the heavy film, paperboard, pressed pulp, and the like. In implementations, the sleeve can be or can be made from recyclable, sustainable, degradable, biodegradable, and like materials.

The fusion packages described herein provide structural integrity to the package at minimal weight cost and permits the package to flex, stretch, and the like during pressure and temperature variations. The fusion packages are stackable and nestable during shipping and for store shelving. The fusion packages can efficiently use recyclable, biodegradable, and the like materials for improved sustainability.

Figure 1A:
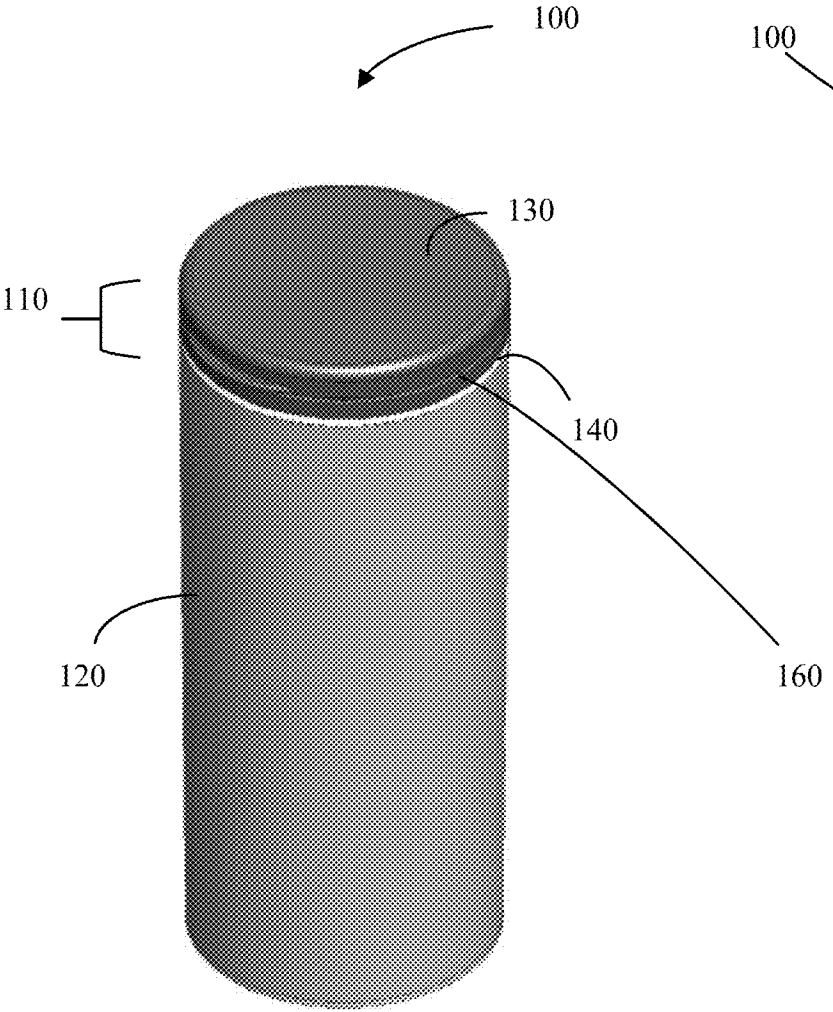

FIG. 1A and FIG. 1B are diagrams of a fusion package 100 in a closed position and an open position, respectively, in accordance with implementations. The fusion package 100 includes a cap 110 and a package body 120. The cap 110 includes a lid 130, a retaining element 140, a tether mechanism 150, and a plurality of rupture members 160 which connect the lid 130, the retaining element 140, and the tether mechanism 150 together in a closed position.

Figure 2:
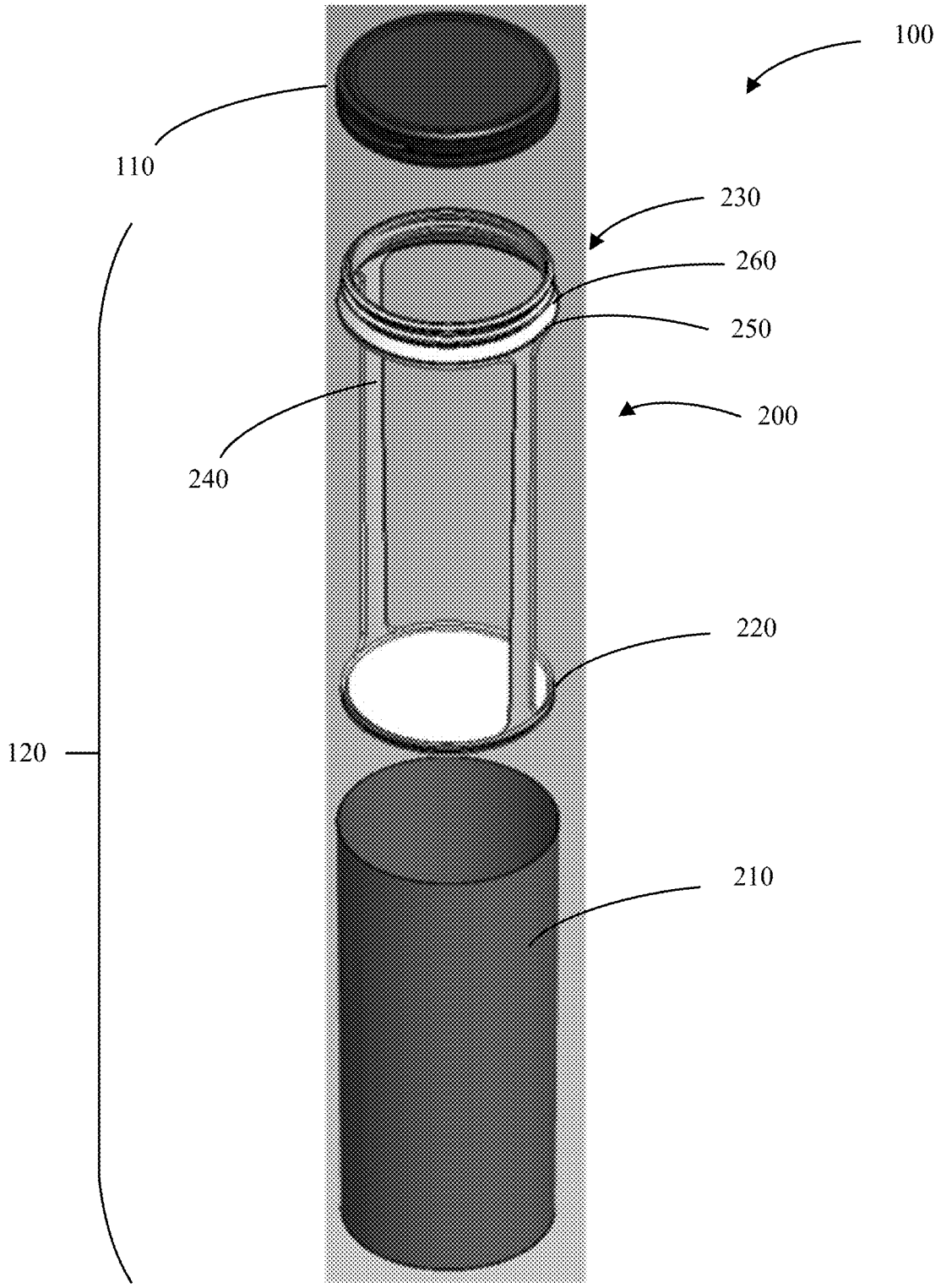
FIG. 2 is an exploded view of the fusion package of FIG. 1A in accordance with implementations.
Figure 3:
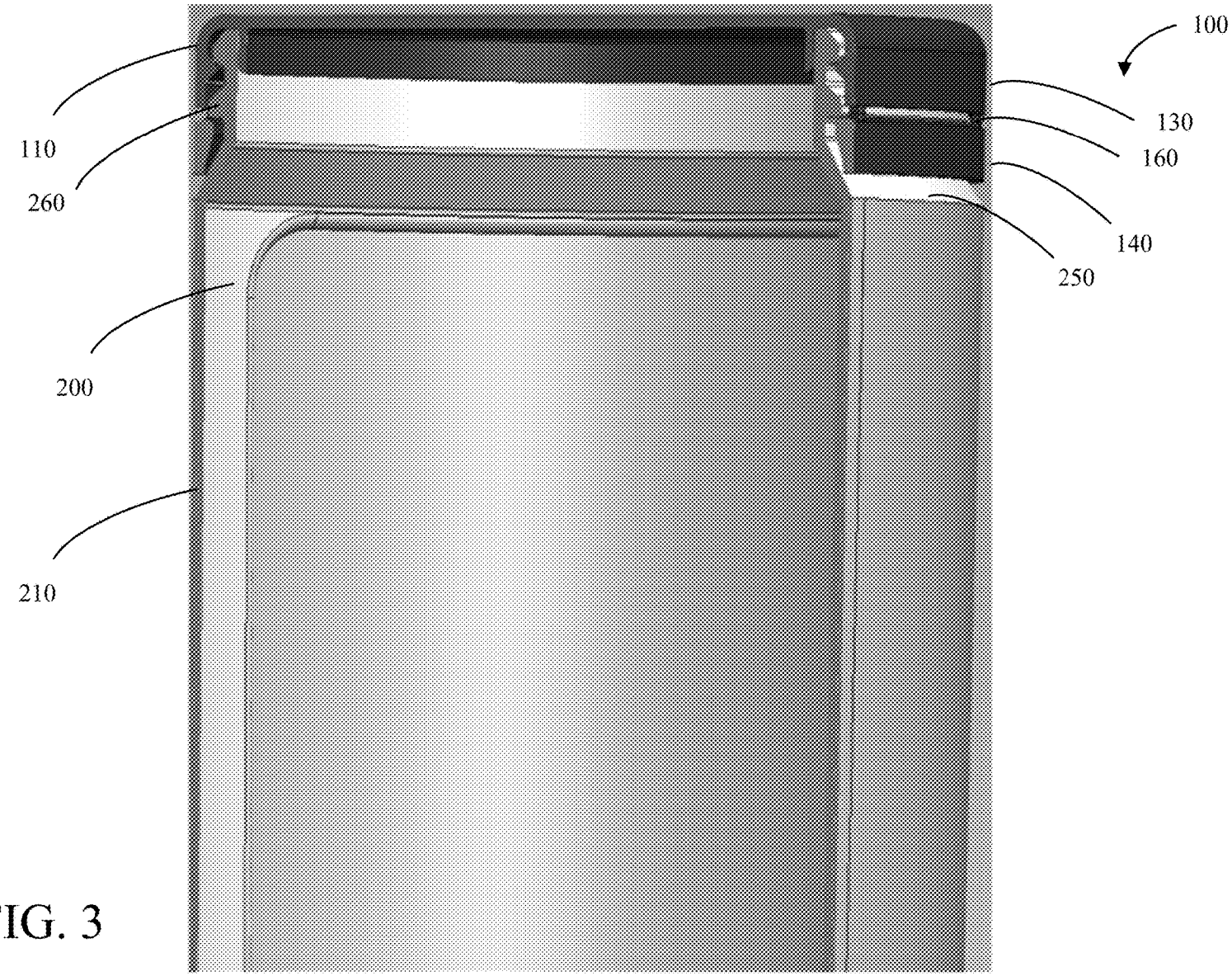
FIG. 3 is a cross-sectional view of the fusion package of FIG. 1A in accordance with implementations.

FIG. 2 is an exploded view of the fusion package 100 of FIG. 1A in accordance with implementations. FIG. 3 is a cross-sectional view of the fusion package 100 of FIG. 1A in accordance with implementations. The package body 120 includes a frame 200 and a sidewall 210. The frame 200 includes a bottom 220, a neck 230, and legs 240 for connecting the bottom 220 and the neck 230. The neck 230 is located at an end of the frame 200 and includes a rim 250 and a retaining element lock mechanism 260 for engaging the retaining element 140. In implementations, the sidewall 210 can be made from heavy film, paperboard, pressed pulp, and the like materials as described herein. In implementations, the sidewall 210 can include a barrier layer or film on an internal or inside surface that faces an interior of the fusion package 100. In implementations, the sidewall 210 can include an integrated barrier layer, film, and/or material. In implementations, the frame 200 can be made using the structure forming processes described herein using the materials described herein.

The fusion package 100 uses the join processing to fuse the frame 200 with the sidewall 210. In implementations, the fusion package 100 includes a liner or foil. In implementations, the fusion package 100 is linerless or foilless. The fusion package 100 is filled from a top and then the cap 110 is snap fitted onto the neck 230. The fusion package 100 is opened by flipping the lid 130 and tearing the plurality of rupture members 160. The retaining element 140 and the tether mechanism 150 secure the lid 130 to prevent environmental disposal issues and enable sustainability.

Figure 4B:
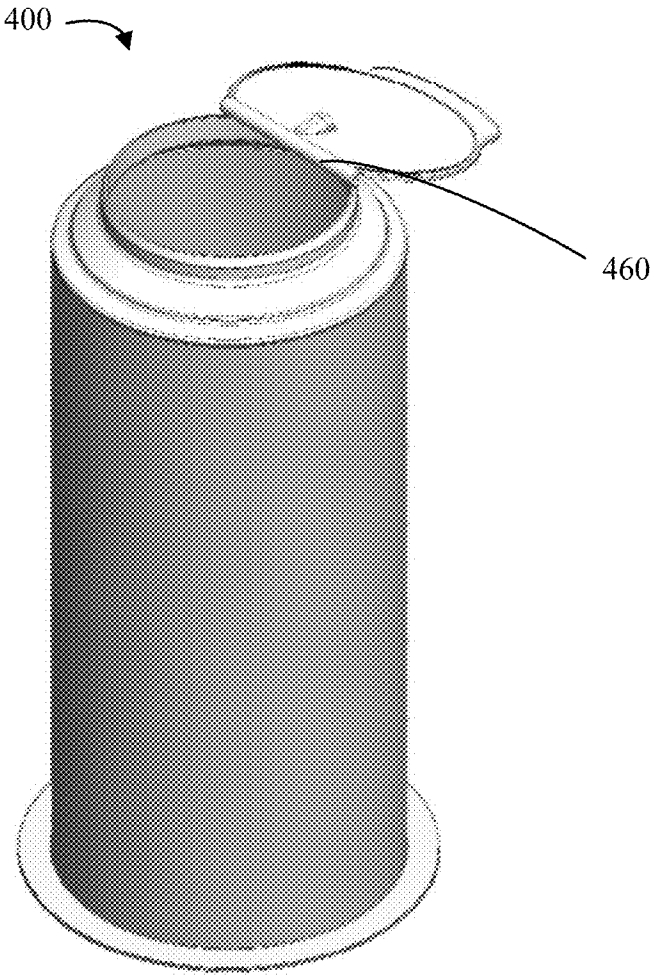
FIG. 4A and FIG. 4B are diagrams of a fusion package in a closed position and an open position, respectively, in accordance with implementations.
Figure 4A:
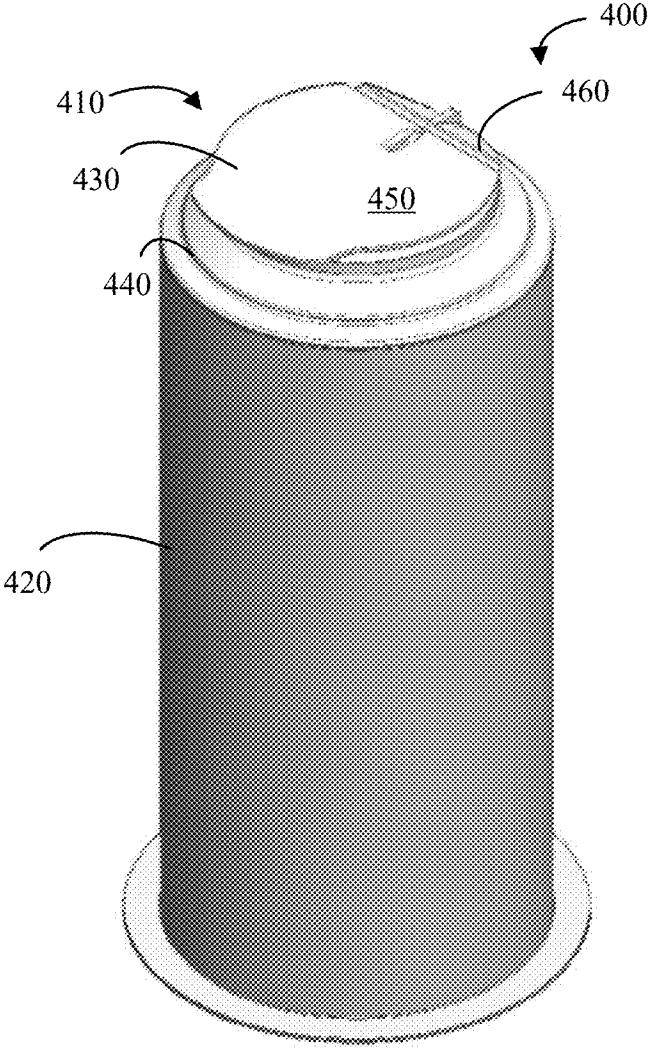

FIG. 4A and FIG. 4B are diagrams of a fusion package 400 in a closed position and an open position, respectively, in accordance with implementations. The fusion package 400 includes a cap portion 410, a package body 420, and a seal (shown in FIG. 5). The cap portion 410 includes a lid 430 and a neck 440. The lid 430 includes a peel portion 450 and a retain portion 460. In implementations, the package body 420 can be made from heavy film, paperboard, pressed pulp, and the like materials as described herein. In implementations, the package body 420 can include a barrier layer or film on an internal or inside surface. In implementations, the package body 420 can include an integrated barrier layer, film, and/or material. In implementations, the package body 420 is tubular shaped. In implementations, the cap portion 410 can be made using the structure forming processes described herein using the materials described herein.

Figure 5:
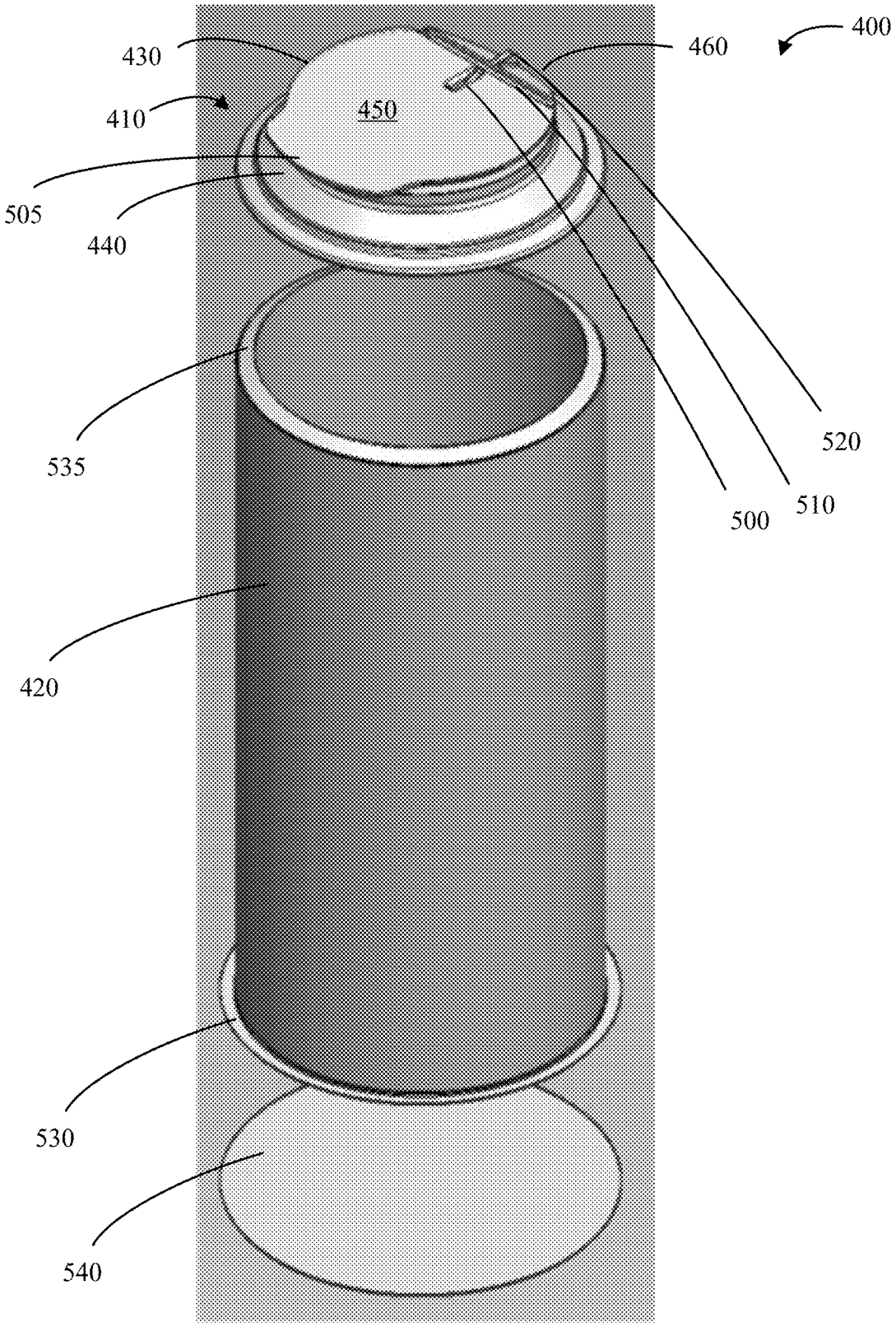
FIG. 5 is an exploded view of the fusion package of FIG. 4A in accordance with implementations.
Figure 6:
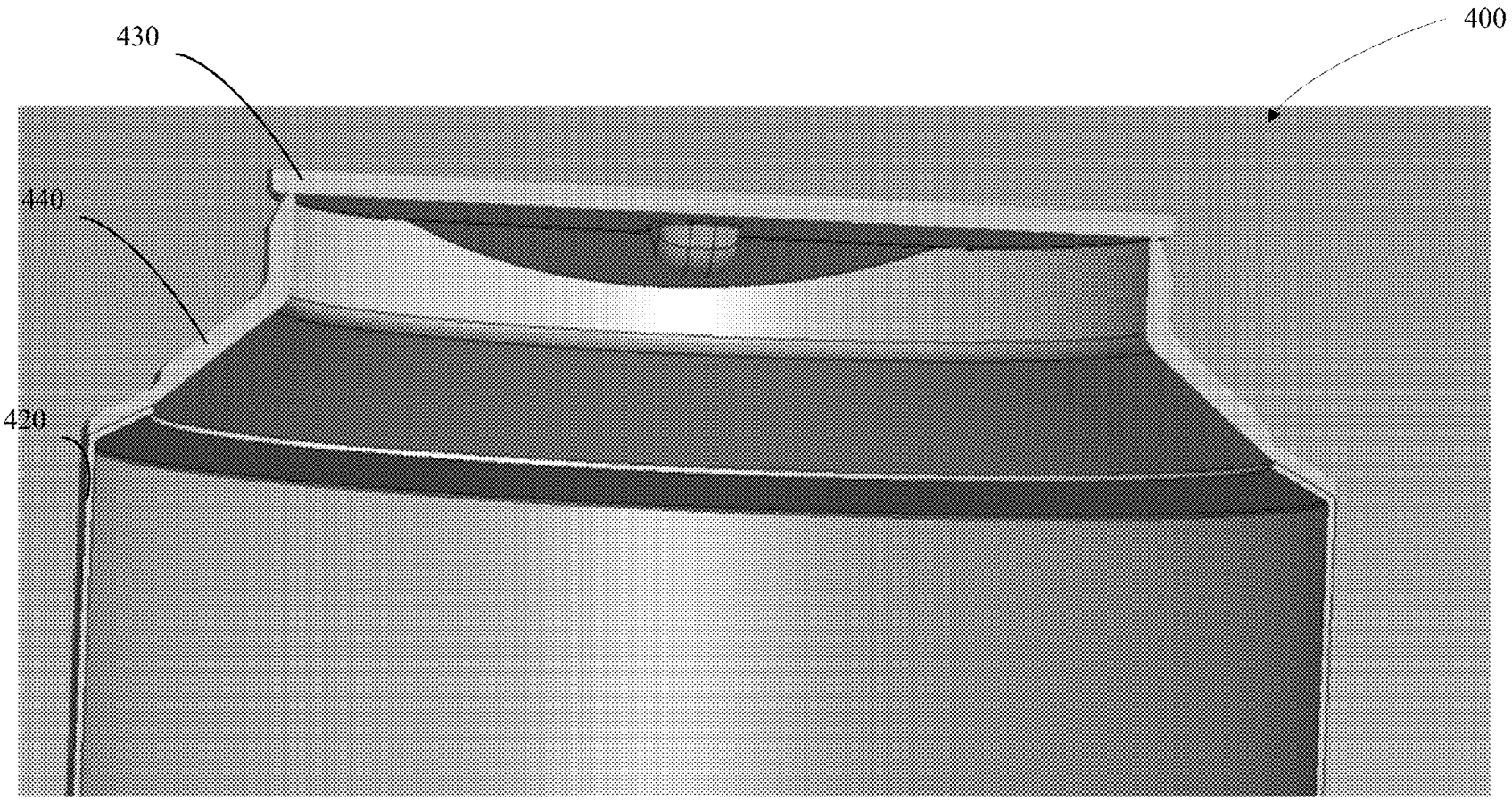
FIG. 6 is a cross-sectional view of the fusion package of FIG. 4A in accordance with implementations.
Figure 7A:
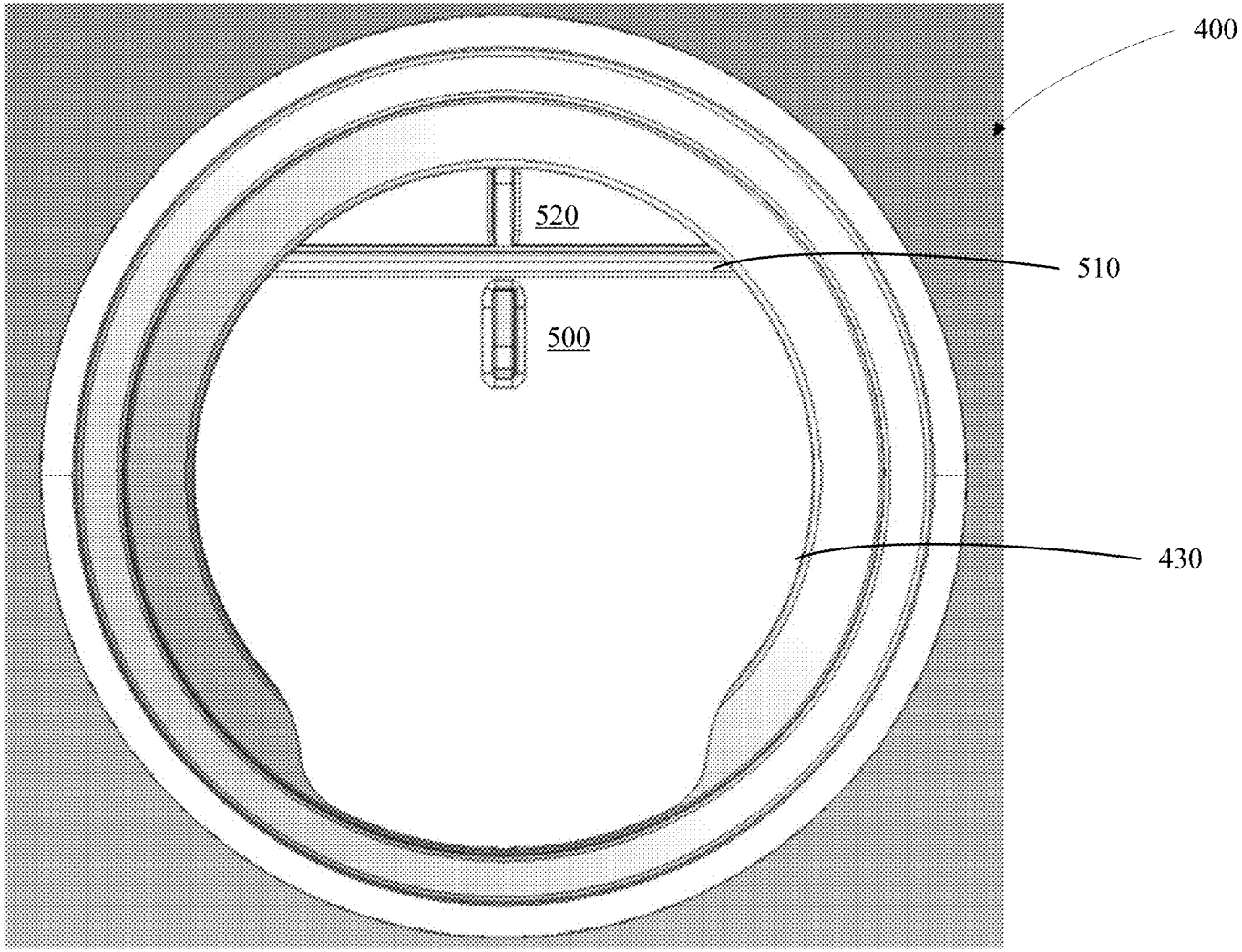
FIG. 7A is a top view of the fusion package of FIG. 4A in accordance with implementations.
Figure 7B:
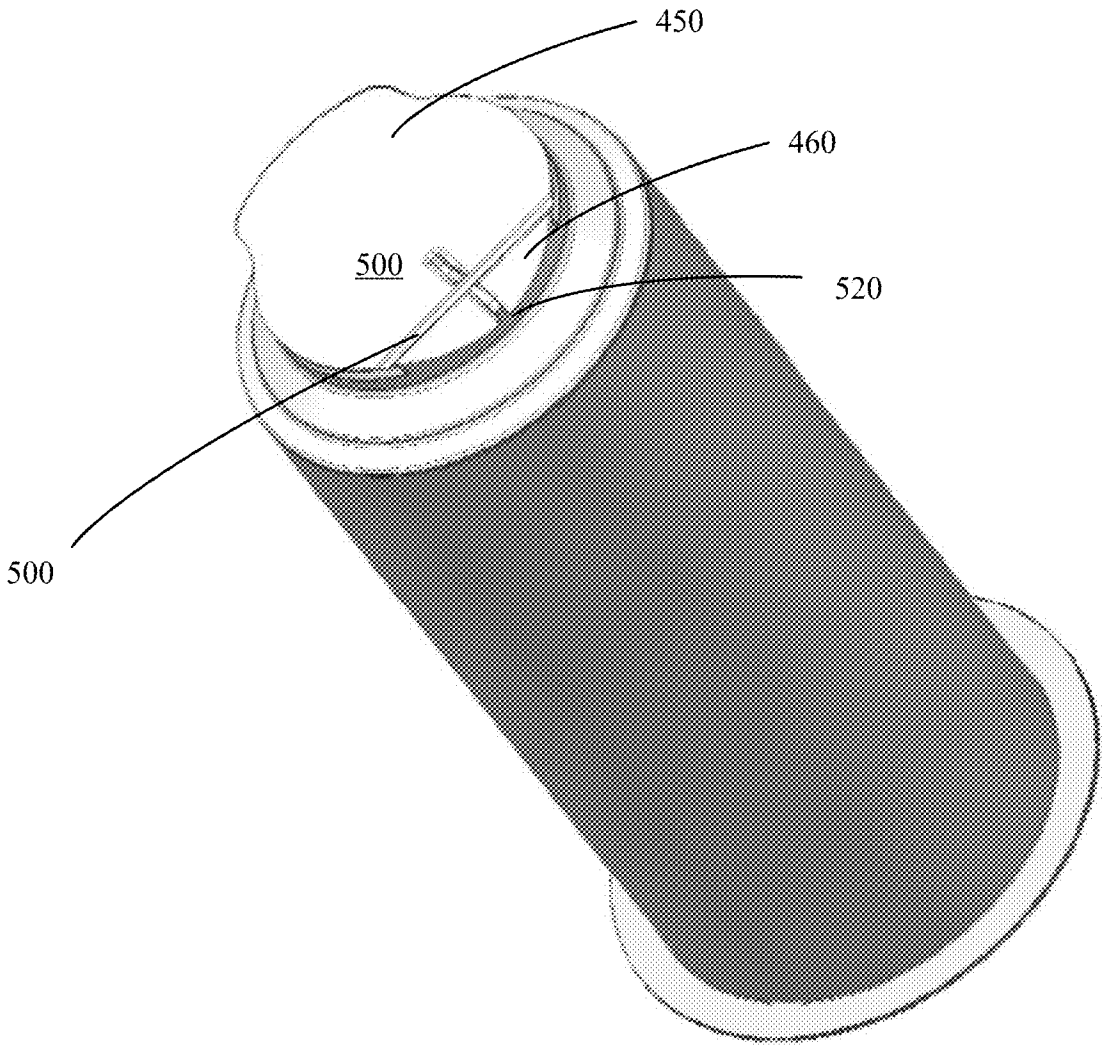
FIG. 7B is a perspective view of the fusion package of FIG. 4A in accordance with implementations.

FIG. 5 is an exploded view of the fusion package 400 of FIG. 4A in accordance with implementations, FIG. 6 is a cross-sectional view of the fusion package 400 of FIG. 4A in accordance with implementations, FIG. 7A is a top view of the fusion package of FIG. 4A in accordance with implementations, and FIG. 7B is a perspective of the fusion package of FIG. 4A in accordance with implementations. The peel portion 450 includes a retain groove 500 and tab portion 505. The retain portion 460 includes a retain projection 520 for engagement with the retain groove 500. A hinge portion 510 portion flexibly or hingedly connects the retain portion 460 and the peel portion 450. The package body 420 includes a flange 530 and a rim 535. A seal 540 is configured to engage the flange 530 when closing or sealing the fusion package 400.

The fusion package 400 uses the join processing to fuse the cap portion with the rim 535 of the package body 420. The fusion package 400 is filled from a bottom and then the seal 540 is fused to the flange 530 using the join processing processes. In implementations, fusing of the seal 540 can be done at a content or material production site. That is, a non-sealed fusion package 400 can be shipped to a manufacturer of the material, who can then fill and seal the fusion package 400. The fusion package 400 is opened by pulling up on the tab portion 505 to peel the peel portion 450 away from the neck 440 until hitting the hinge portion 510, which prevents environmental disposal issues and enables sustainability. In implementations, the retain groove 500 can engage the retain projection 520 to keep peel portion 450 from interfering in accessing the content or material in the fusion package 400. In implementations, the peel portion 450 can be torn away at the hinge portion 510 with only the retain portion 460 remaining.

Figure 8B:
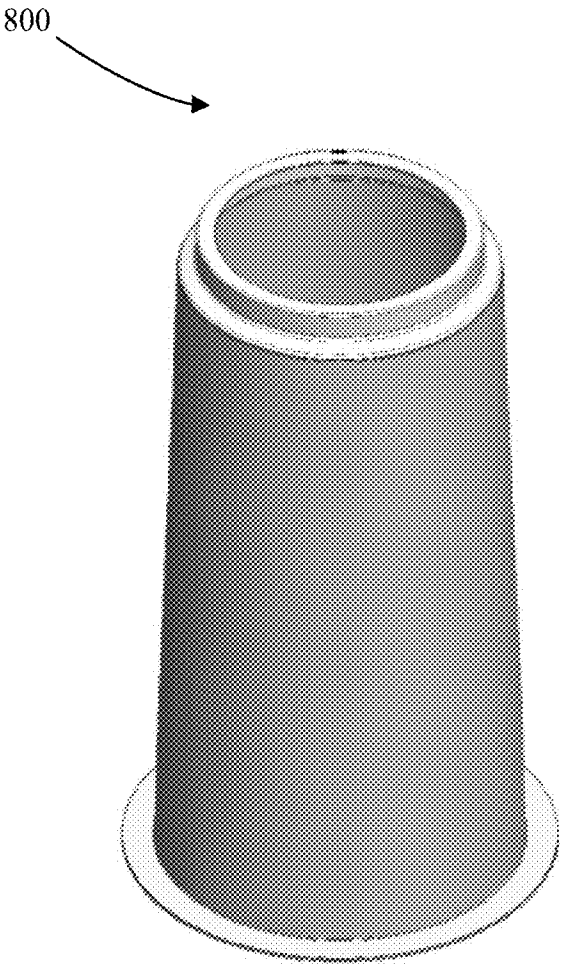
FIG. 8A and FIG. 8B are diagrams of a fusion package in a closed position and an open position, respectively, in accordance with implementations.
Figure 8A:
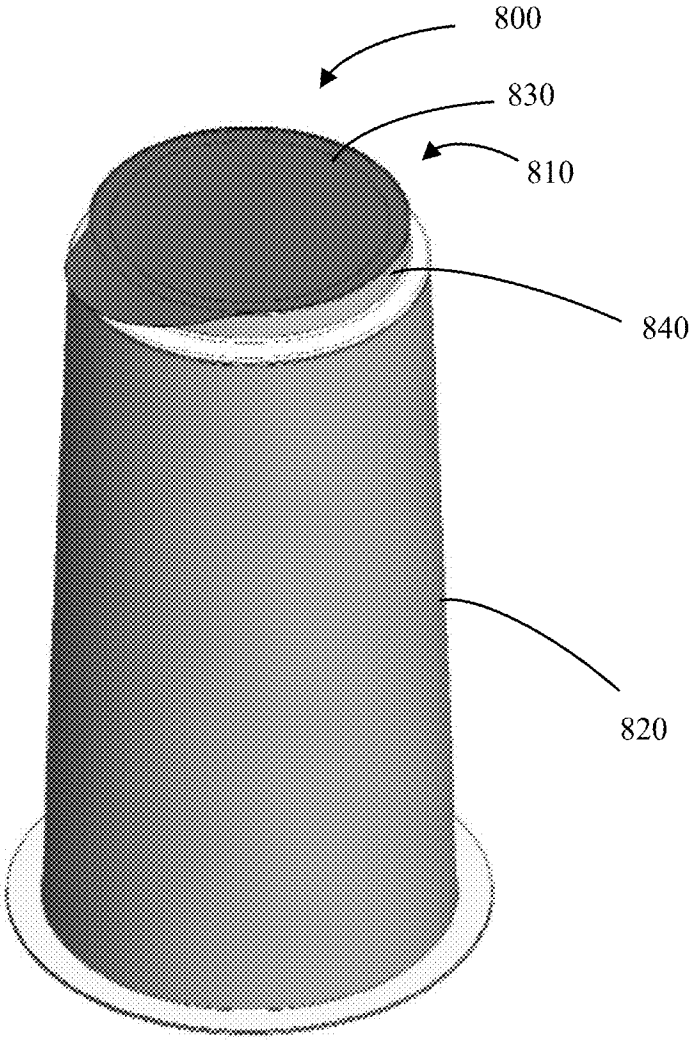

FIG. 8A and FIG. 8B are diagrams of a fusion package 800 in a closed position and an open position, respectively, in accordance with implementations. The fusion package 800 includes a cap portion 810, a package body 820, and a seal (shown in FIG. 9). The cap portion 810 includes a peelable seal 830 and a neck 840. In implementations, the package body 820 can be made from heavy film, paperboard, pressed pulp, and the like materials as described herein. In implementations, the package body 820 can include a barrier layer or film on an internal or inside surface. In implementations, the package body 820 can include an integrated barrier layer, film, and/or material. In implementations, the package body 820 is tubular, conical, and other shapes as described herein. In implementations, the cap portion 810 can be made using the structure forming processes described herein using the materials described herein.

Figure 9:
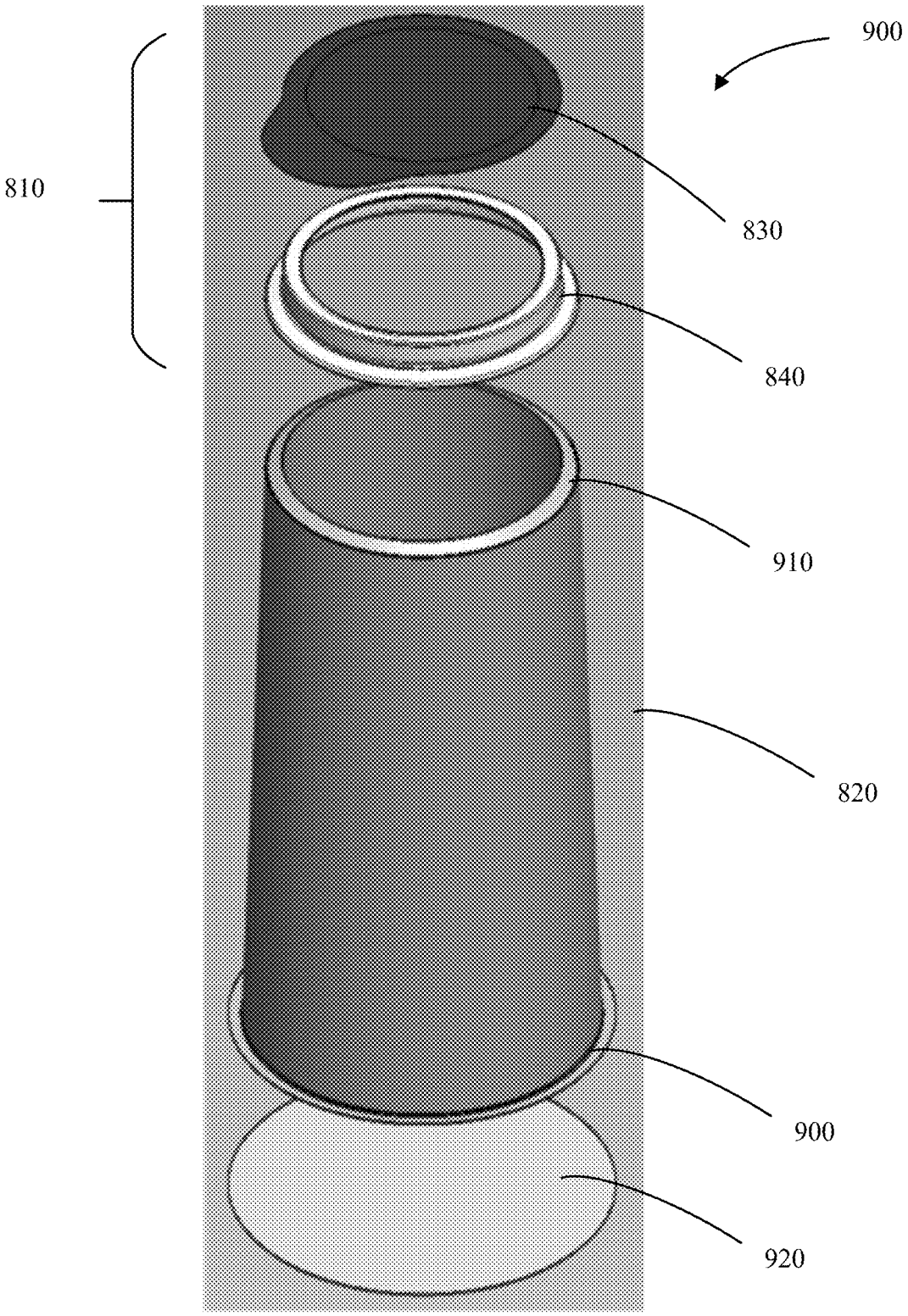
FIG. 9 is an exploded view of the fusion package of FIG. 8A in accordance with implementations.
Figure 10:
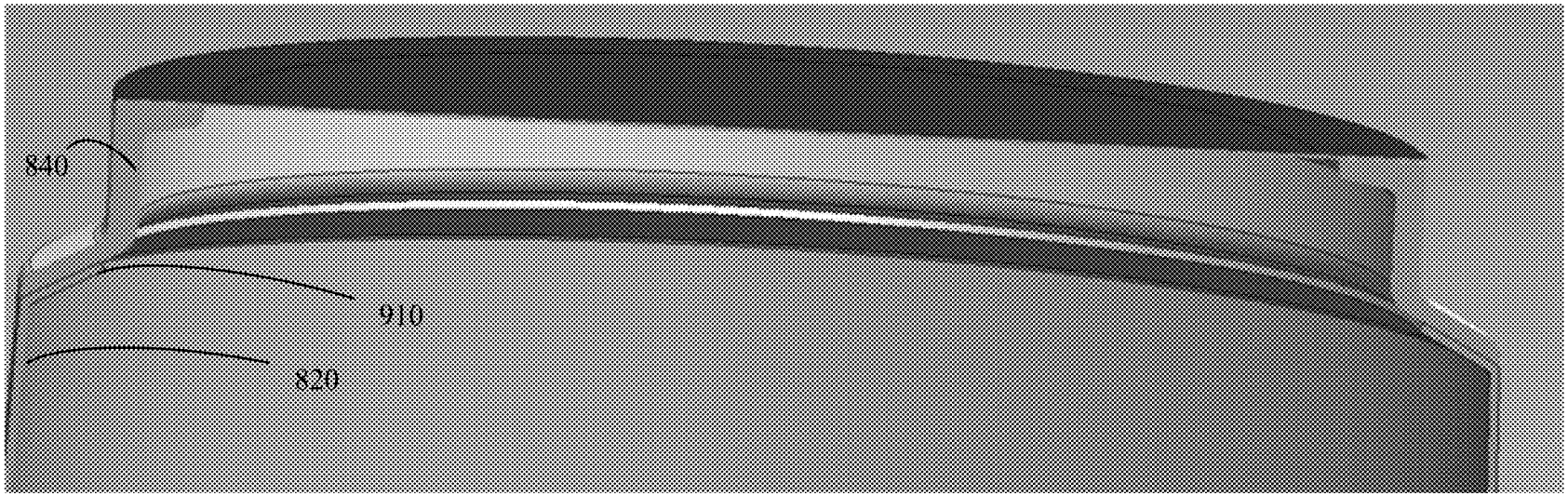
FIG. 10 is a cross-sectional view of the fusion package of FIG. 8A in accordance with implementations.

FIG. 9 is an exploded view of the fusion package 800 of FIG. 8A in accordance with implementations and FIG. 10 is a cross-sectional view of the fusion package 800 of FIG. 8A in accordance with implementations. The package body 820 includes a flange 900 and a rim 910. A seal 920 is configured to engage the flange 900 when closing the fusion package 800.

The fusion package 800 uses the join processing to fuse the peelable seal 830 to the neck 840 and the cap portion 810 with the rim 910 of the package body 820. The fusion package 800 is filled from a bottom and then the seal 920 is fused to the flange 900. In implementations, fusing of the seal 920 can be done at a content or material production site. That is, a non-sealed fusion package 800 can be shipped to a manufacturer of the material, who can then fill and seal the fusion package 800. The fusion package 800 is opened by tearing the peelable seal 830.

Figure 11B:
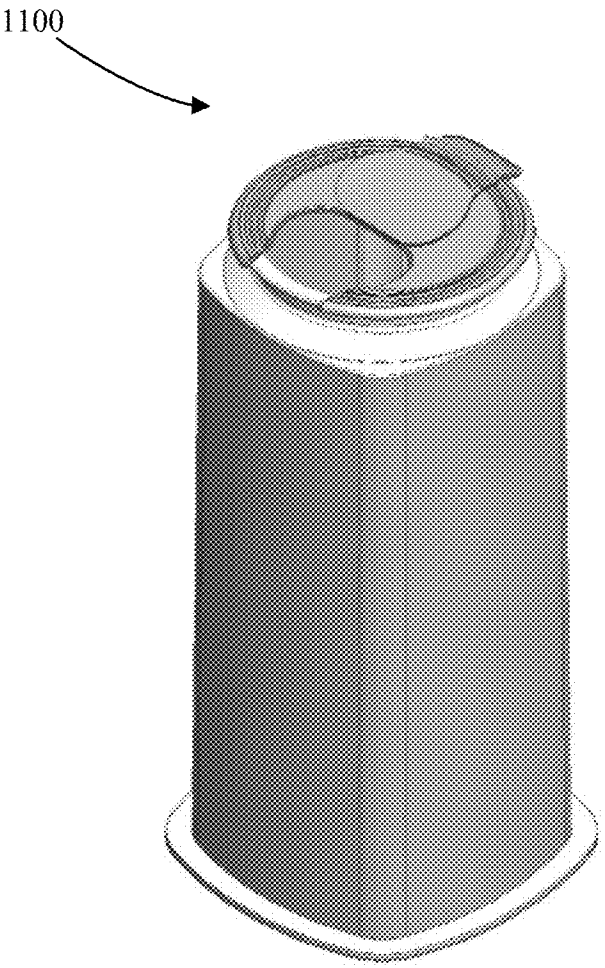
FIG. 11A and FIG. 11B are diagrams of a fusion package in a closed position and an open position, respectively, in accordance with implementations.
Figure 11A:
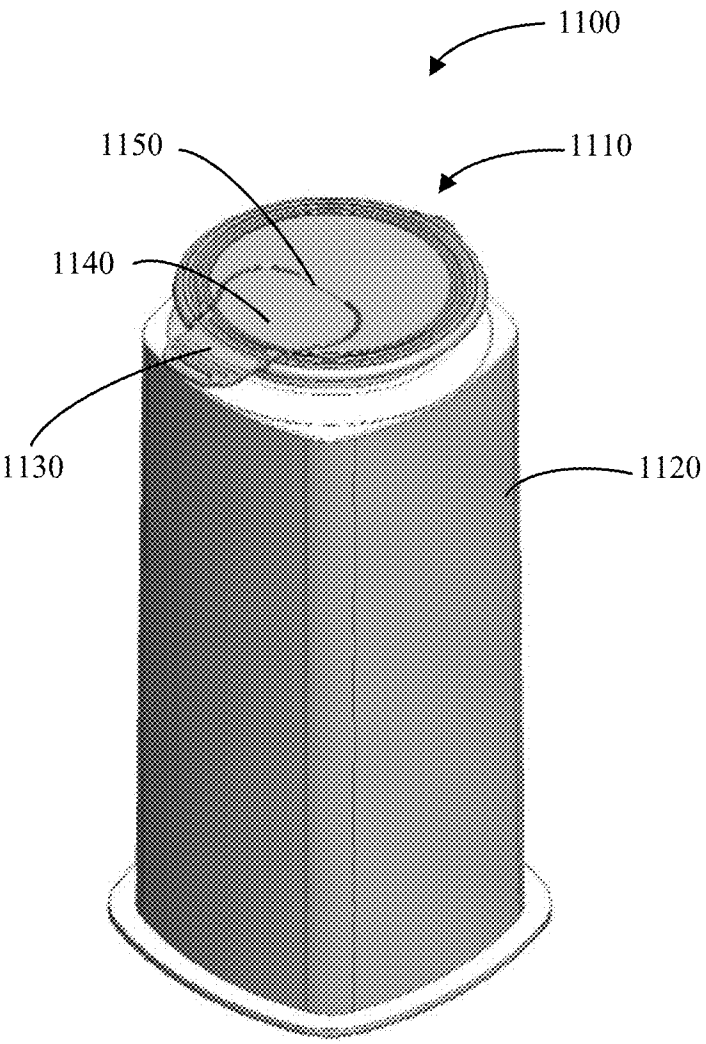

FIG. 11A and FIG. 11B are diagrams of a fusion package 1100 in a closed position and an open position, respectively, in accordance with implementations. The fusion package 1100 includes a cap 1110 and a package body 1120. The cap 1110 includes a tab element 1130 that extends beyond an outer peripheral edge of the cap 1110, a tearable membrane portion 1140, and a retain portion or tether mechanism 1150. In implementations, the tether mechanism 1150 is a hinge-like mechanism.

Figure 12:
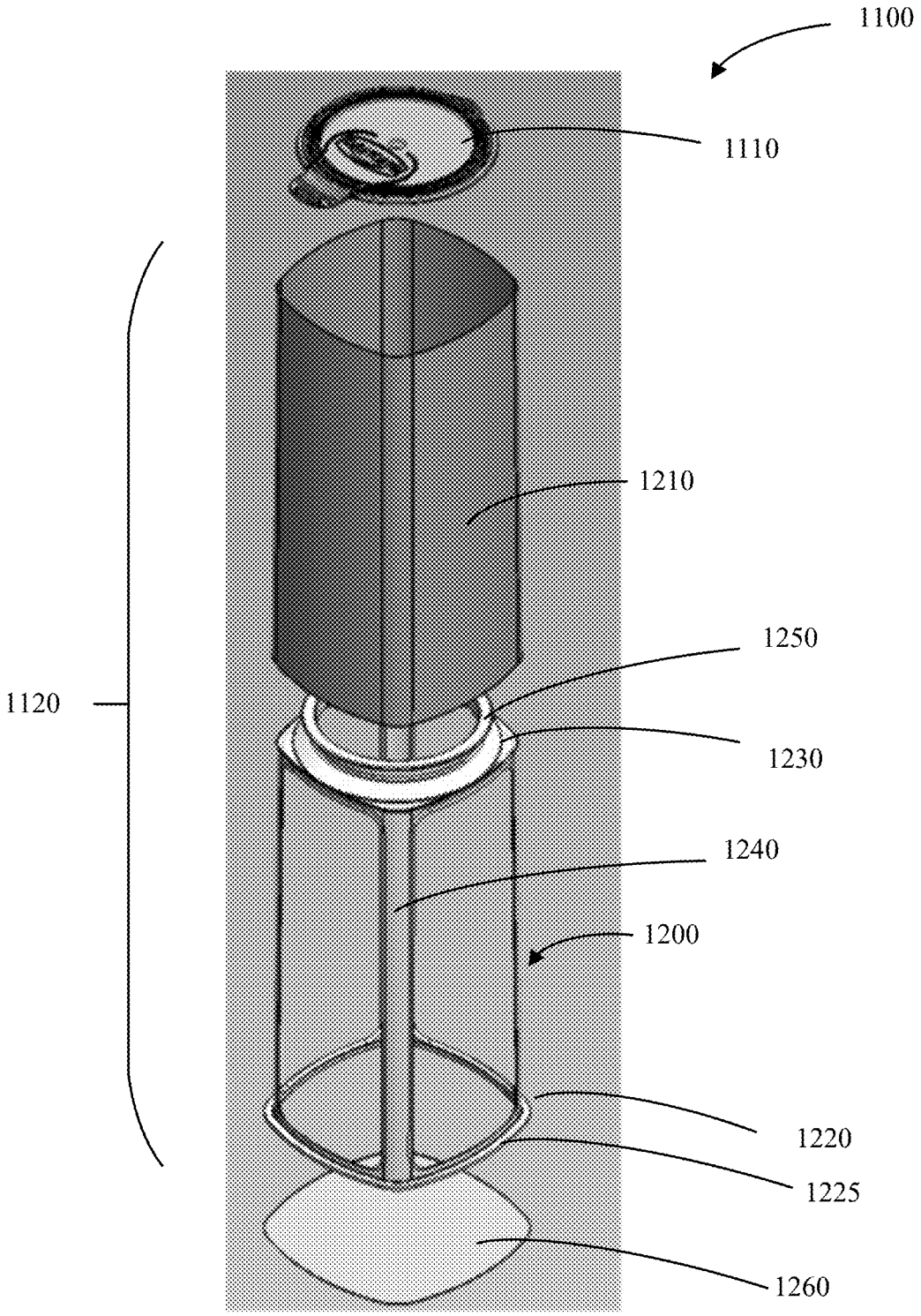
FIG. 12 is an exploded view of the fusion package of FIG. 11A in accordance with implementations.
Figure 13:
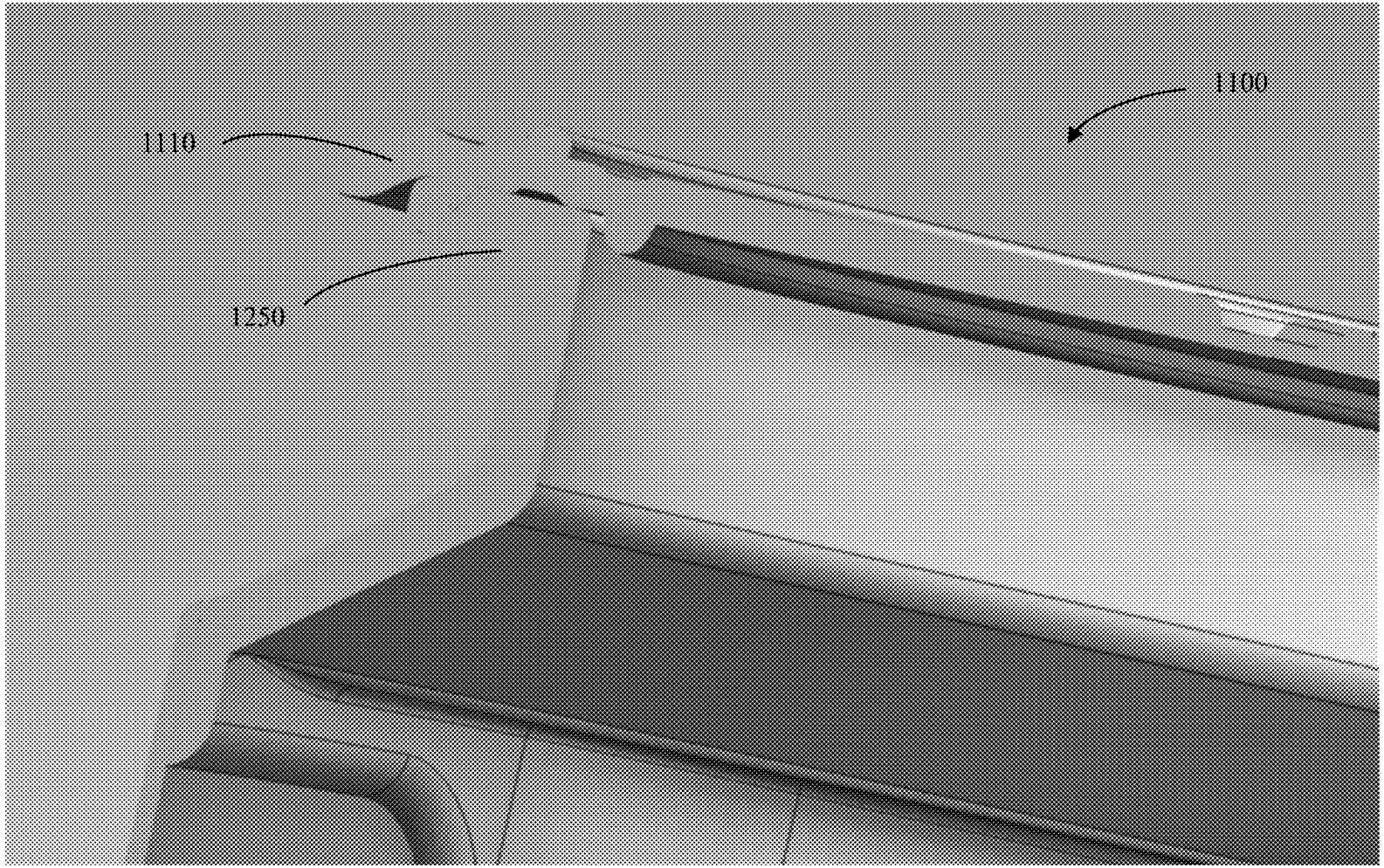
FIG. 13 is a cross-sectional view of the fusion package of FIG. 11A in accordance with implementations.

FIG. 12 is an exploded view of the fusion package 1100 of FIG. 11A in accordance with implementations, FIG. 13 is a cross-sectional view of the fusion package 1100 of FIG.

Figure 14:
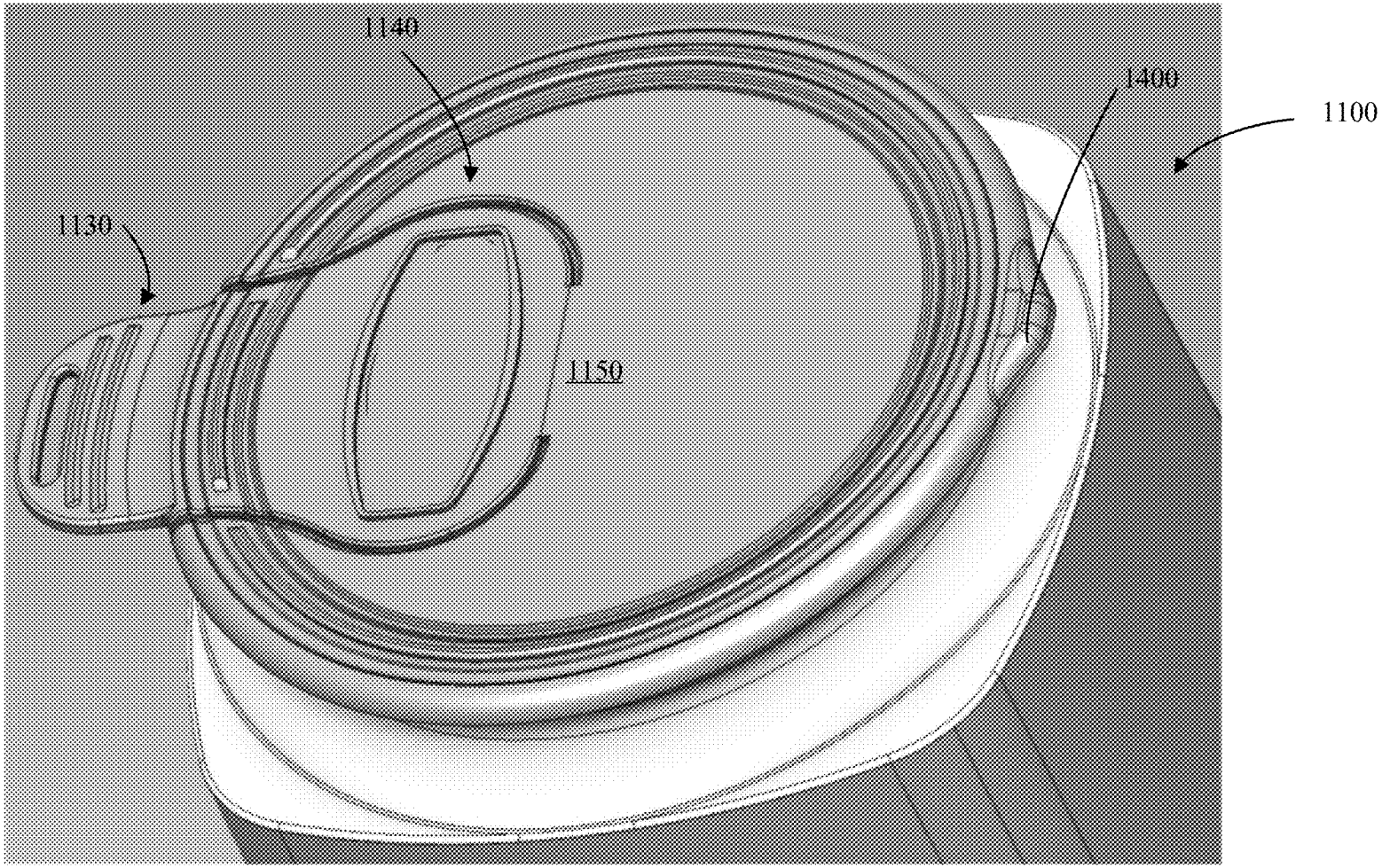
FIG. 14 is a top view of the fusion package of FIG. 11A in accordance with implementations.
Figure 15:
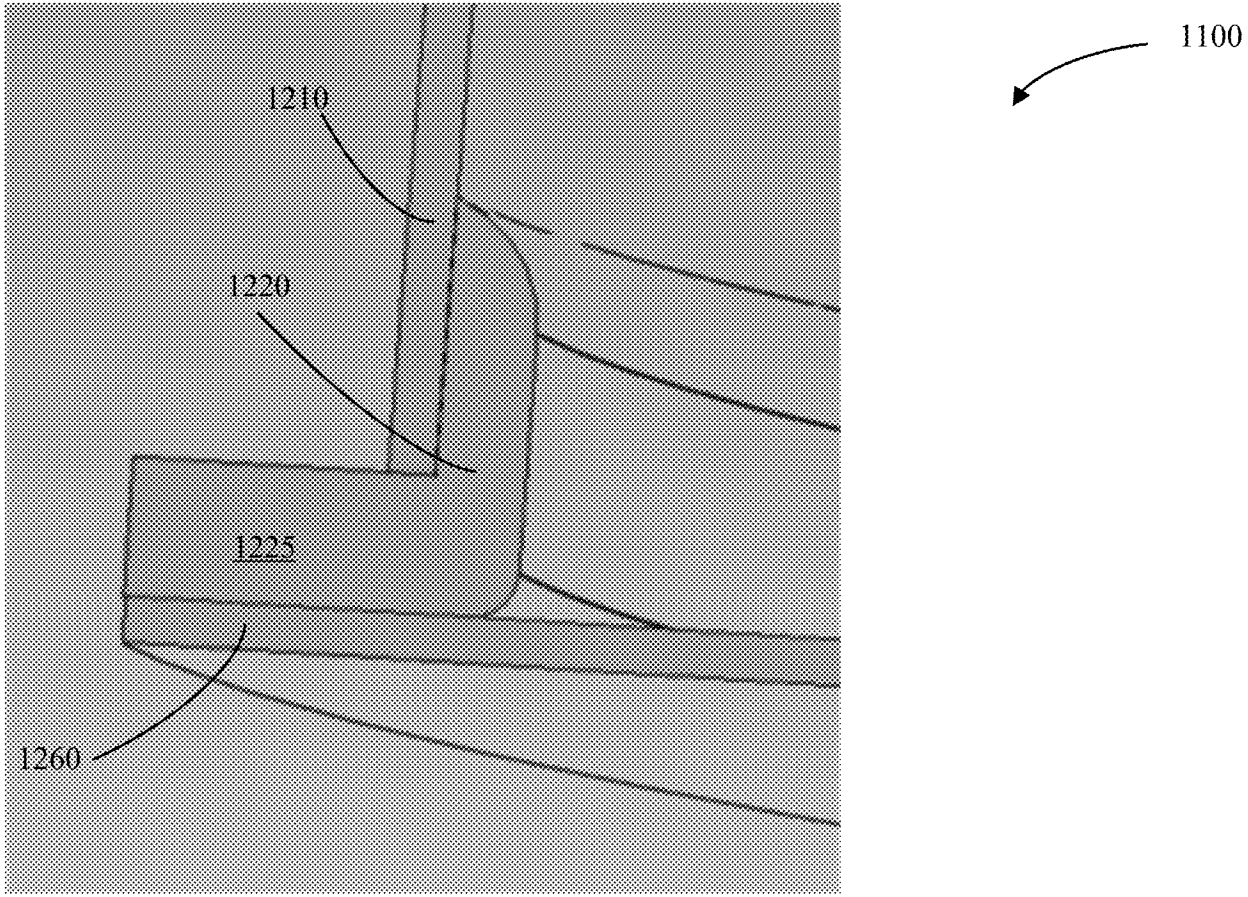
FIG. 15 is a cross-sectional view of the fusion package of FIG. 11A in accordance with implementations.

11A in accordance with implementations, FIG. 14 is a top view of the fusion package 1100 of FIG. 11A in accordance with implementations, and FIG. 15 is a cross-sectional view of the fusion package 1100 of FIG. 11A in accordance with implementations. The package body 1120 includes a frame 1200 and a sidewall 1210. The frame 1200 includes a bottom 1220, a neck 1230, and legs 1240 for connecting the bottom 1220 and the neck 1230. The bottom 1220 includes a flange 1225. The neck 1230 includes a rim 1250. A seal 1260 is configured to engage the flange 1225 when closing the fusion package 1100. The cap 1110 includes a tab element retainer 1400 configured to engage the tab element 1130. In implementations, the sidewall 1210 can be made from heavy film, paperboard, pressed pulp, and the like materials as described herein. In implementations, the sidewall 1210 can include a barrier layer or film on an internal or inside surface. In implementations, the sidewall 1210 can include an integrated barrier layer, film, and/or material. In implementations, the frame 1200 can be made using the structure forming processes described herein using the materials described herein.

The fusion package 1100 uses the join processing to fuse the sidewall 1210 with the frame 1200 and the cap 1110 to the rim 1250. The fusion package 1100 is filled from a bottom and then the seal 1260 is fused to the flange 1225. In implementations, fusing of the seal 1260 can be done at a content or material production site. That is, a non-sealed fusion package 1100 can be shipped to a manufacturer of the material, who can then fill and seal the fusion package 1100. The fusion package 1100 is opened by pulling the tab element 1130 which tears the tearable membrane portion 1140 until hitting the tether mechanism 1150, which prevents environmental disposal issues and enables sustainability. The tab element 1130 engages the tab element retainer 1400 to prevent interference with disposal of the content or material.

Figure 16B:
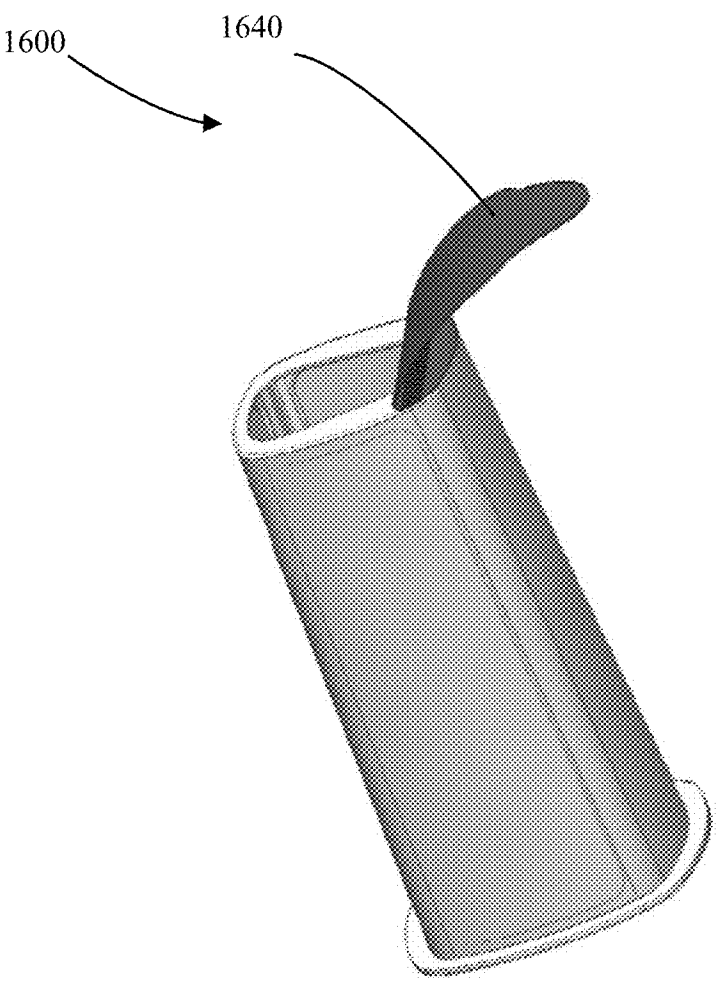
FIG. 16A and FIG. 16B are diagrams of a fusion package in a closed position and an open position, respectively, in accordance with implementations.
Figure 16A:
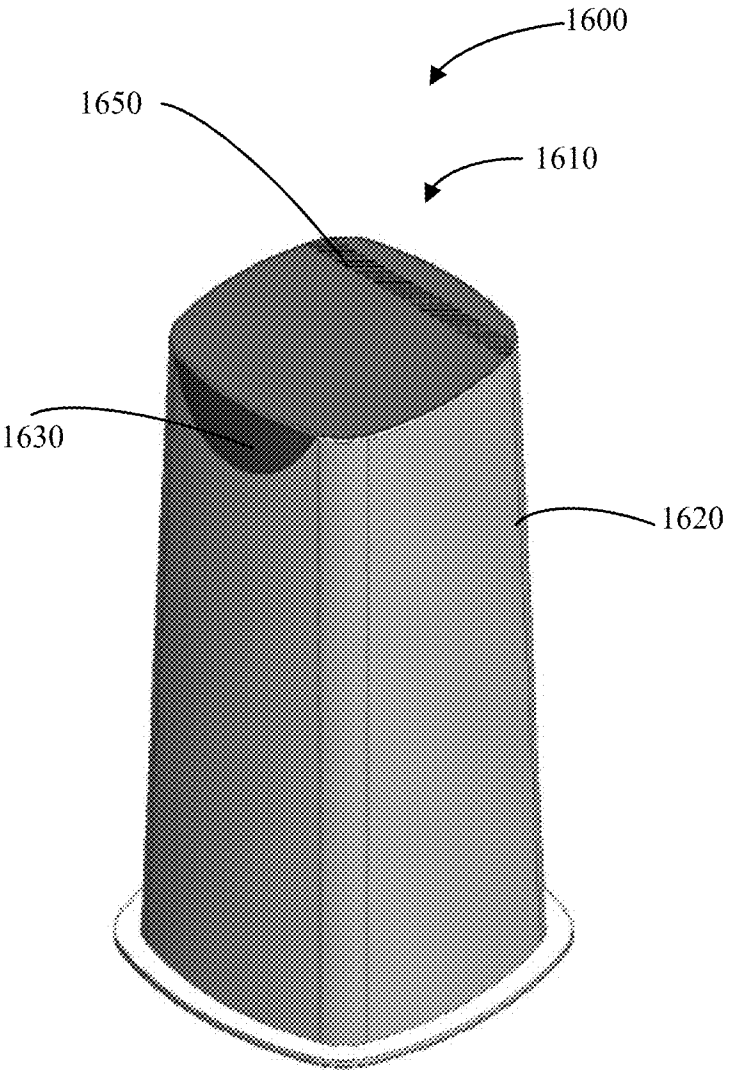

FIG. 16A and FIG. 16B are diagrams of a fusion package 1600 in a closed position and an open position, respectively, in accordance with implementations. The fusion package 1600 includes a seal 1610 and a package body 1620. The seal 1610 includes a tab element 1630, a peelable portion 1640, and a retain portion or tether mechanism 1650. In implementations, the tether mechanism 1650 is a hinge-like mechanism.

Figure 17:
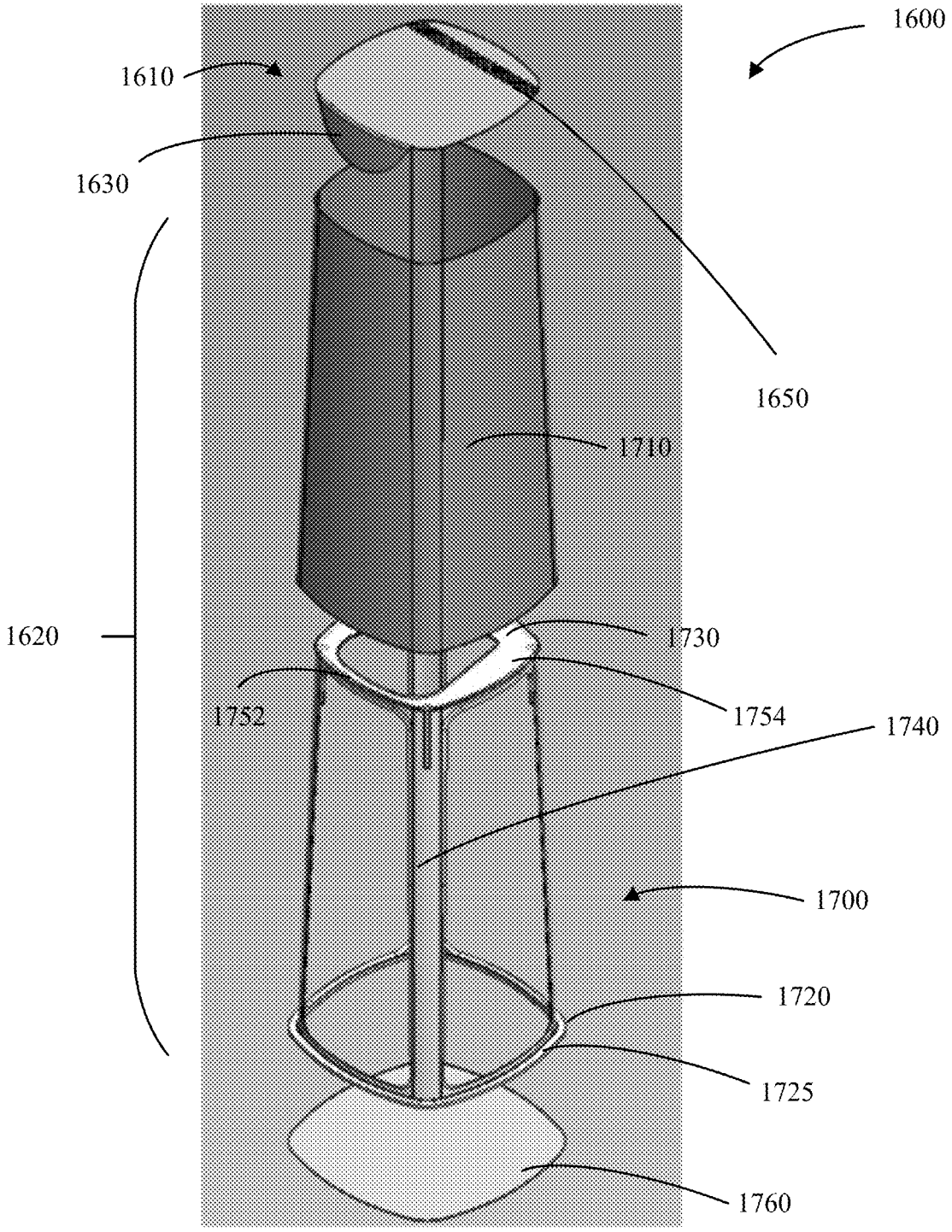
FIG. 17 is an exploded view of the fusion package of FIG. 16A in accordance with implementations.
Figure 18:
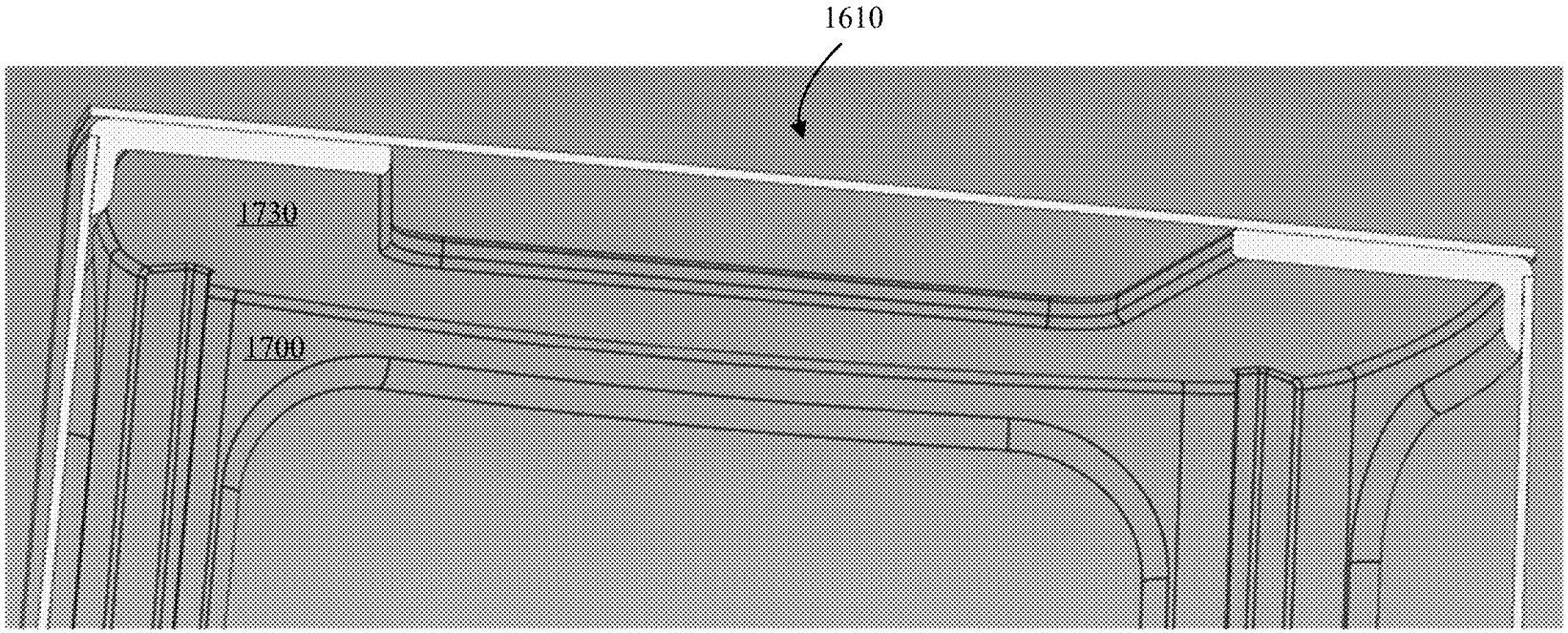
FIG. 18 is a cross-sectional view of the fusion package of FIG. 16A in accordance with implementations.
Figure 19A:
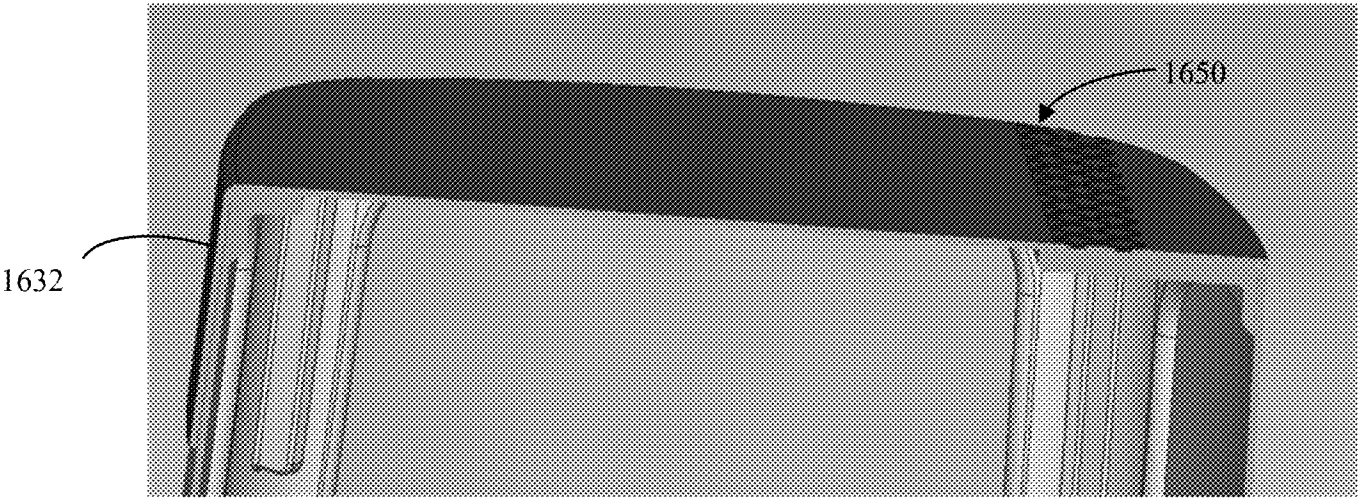
FIG. 19A and FIG. 19B are cross-sectional views of the fusion package of FIG. 16A in accordance with implementations.
Figure 19B:
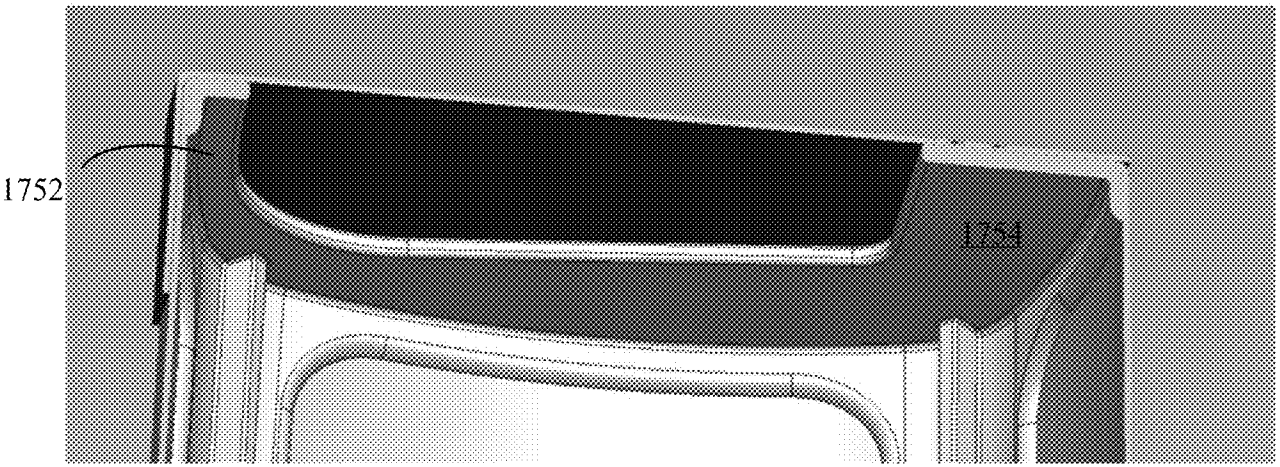

FIG. 17 is an exploded view of the fusion package 1600 of FIG. 16A in accordance with implementations, FIG. 18 is a cross-sectional view of the fusion package 1600 of FIG. 16A in accordance with implementations, FIG. 19A is a top cross-sectional view of the fusion package 1600 of FIG. 16A in accordance with implementations, and FIG. 19B is a top cross-sectional view of the fusion package 1600 of FIG. 16A in accordance with implementations. The package body 1620 includes a frame 1700 and a sidewall 1710. The frame 1700 includes a bottom 1720, a neck 1730, and a pair of legs 1740 for connecting the bottom 1720 and the neck 1730. The bottom 1720 includes a flange 1725. The neck 1730 includes a rim 1750 having a narrow section 1752 and a wide section 1754. A seal 1760 is configured to engage the flange 1725 when closing the fusion package 1600. As shown in FIG. 19A and FIG. 19B, the tether mechanism 1650 is situated on the wide section 1754 of the rim 1750. In implementations, the sidewall 1710 can be made from heavy film, paperboard, pressed pulp, and the like materials as described herein. In implementations, the sidewall 1710 can include a barrier layer or film on an internal or inside surface. In implementations, the sidewall 1710 can include an integrated barrier layer, film, and/or material. In implementations, the frame 1700 can be made using the structure forming processes described herein using the materials described herein.

The fusion package 100 uses the join processing to fuse the sidewall 1710 with the frame 1700, a portion of the peelable portion 1640 to portions of the rim 1750, and a portion 1632 of the tab element 1630 with the sidewall 1710, as shown in FIG. 19A. The fusion package 1700 is filled from a bottom and then the seal 1760 is fused to the flange 1725. In implementations, fusing of the seal 1760 can be done at a content or material production site. That is, a non-sealed fusion package 1600 can be shipped to a manufacturer of the material, who can then fill and seal the fusion package 1600. The fusion package 1600 is opened by pulling the portion 1632 of the tab element 1630 and the tab element 1130 which peels the peelable portion 1640 until hitting the tether mechanism 1650, which prevents environmental disposal issues and enables sustainability.

Figure 20:
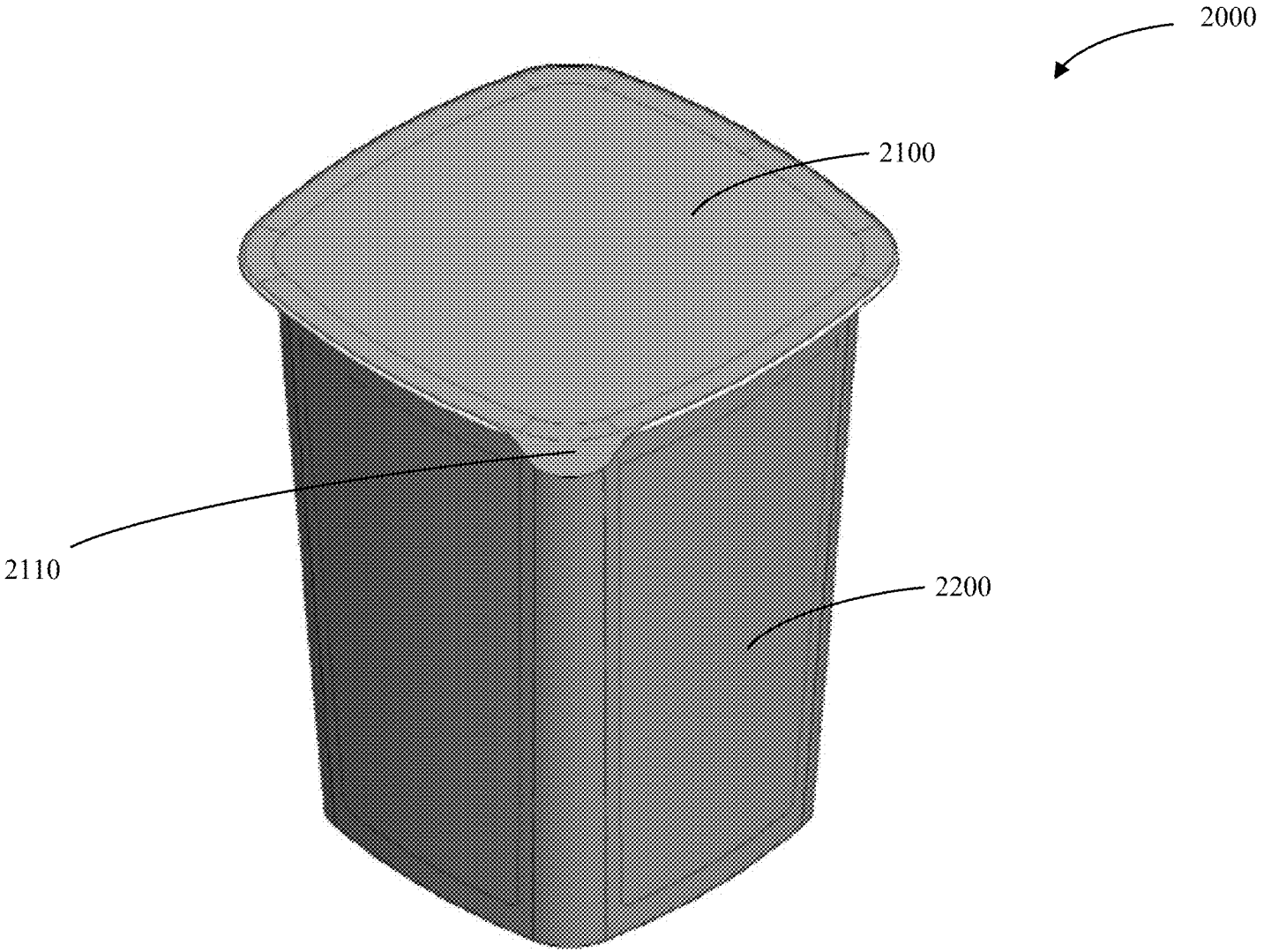
FIG. 20 is a diagram of a fusion package in a closed position in accordance with implementations.
Figure 21:
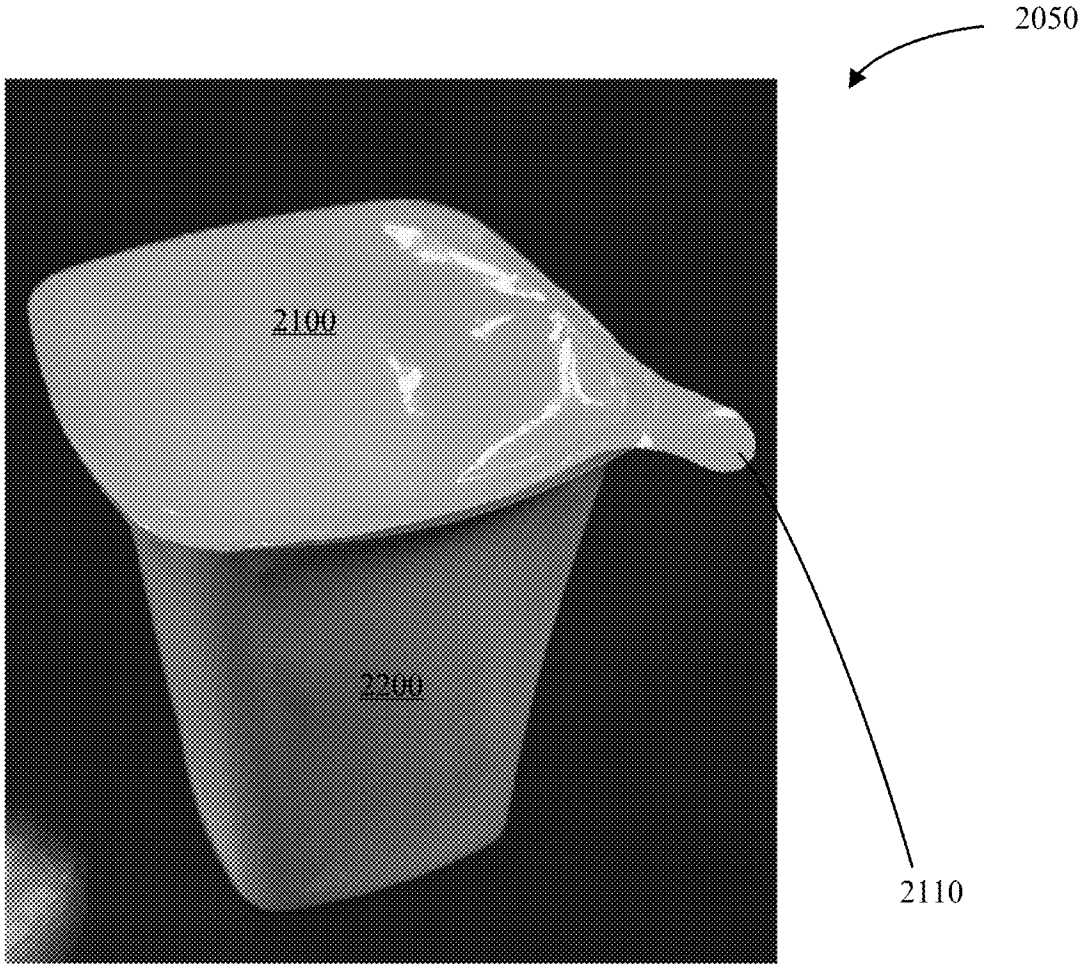
FIG. 21 is an example photo of the fusion package of FIG. 20 in accordance with implementations.
Figure 22:
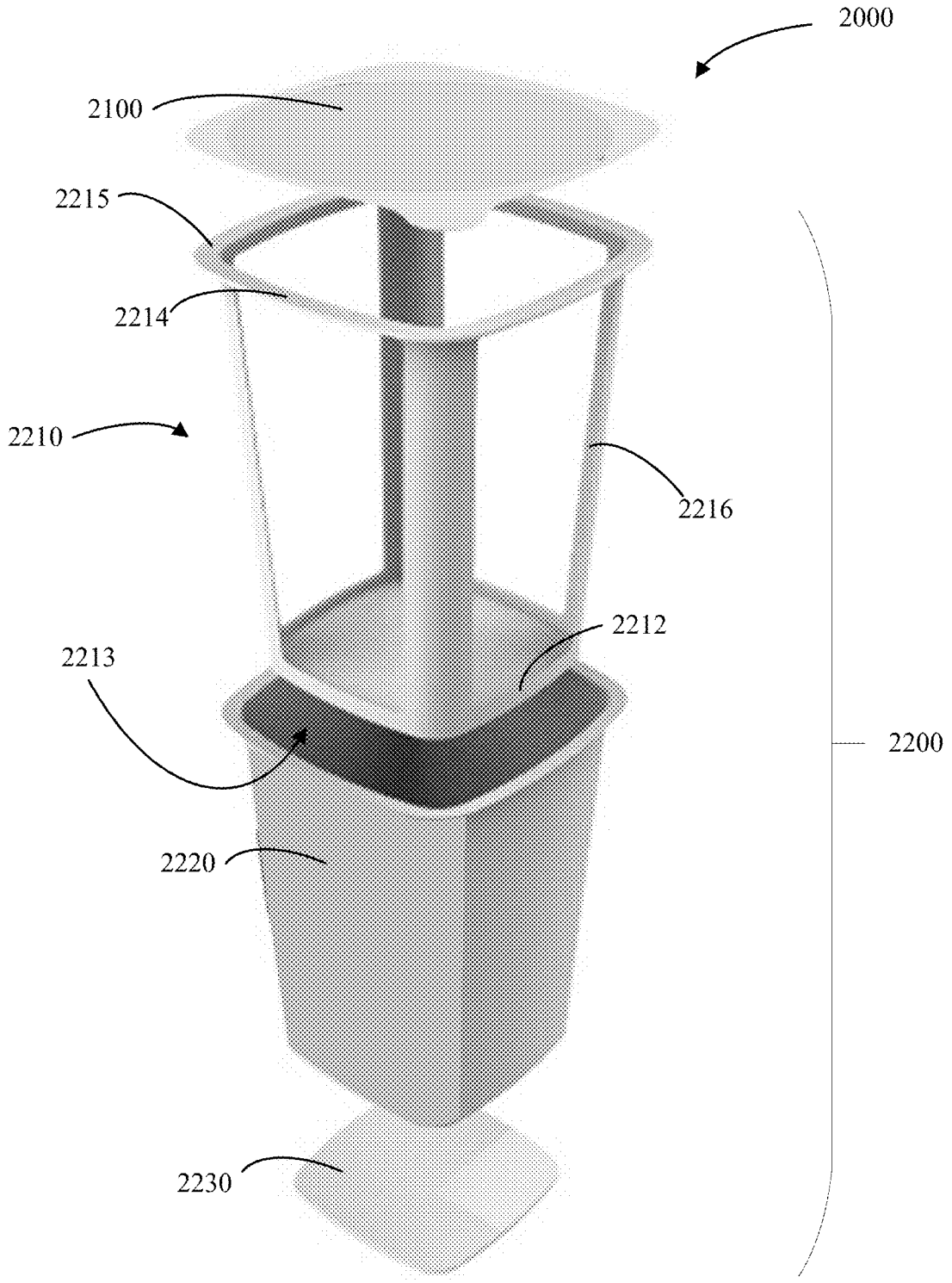
FIG. 22 is an exploded view of the fusion package of FIG. 20 in accordance with implementations.

FIG. 20 is a diagram of a fusion package 2000 in a closed position in accordance with implementations. FIG. 21 is an example photo 2100 of the fusion package 2000 in accordance with implementations. FIG. 22 is an exploded view of the fusion package 2000 in accordance with implementations. The fusion package 2000 includes a seal 2100 and a package body 2200. The seal 2100 includes a pull tab 2110. The package body 2200 a frame 2210, a sidewall 2220 and a seal 2230. The frame 2210 includes a bottom 2212, a neck 2214, and legs 2216 for connecting the bottom 2212 and the neck 2214. The bottom 2212 includes a surface 2213. The neck 2214 includes a rim 2215. In implementations, the sidewall 2220 can be made from heavy film, paperboard, pressed pulp, and the like materials as described herein. In implementations, the sidewall 2220 can include a barrier layer or film on an internal or inside surface. In implementations, the sidewall 2220 can include an integrated barrier layer, film, and/or material. In implementations, the frame 2210 can be made using the structure forming processes described herein using the materials described herein.

The fusion package 100 uses the join processing to fuse the sidewall 2220, the frame 2210, and the seal 2230 together. The fusion package 2000 is filled from a top and then the seal 2100 is fused to the rim 2215. In implementations, fusing of the cap 2100 can be done at a content or material production site. That is, a non-sealed fusion package 2000 can be shipped to a manufacturer of the material, who can then fill and seal the fusion package 2000. The fusion package 2000 is opened by peeling the cap 2100.

Figure 23B:
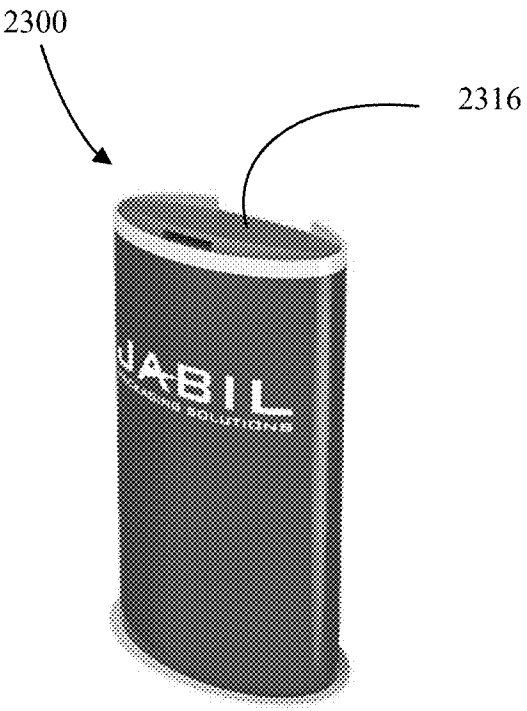
FIG. 23A and FIG. 23B are diagrams of a fusion package in a closed position and an open position, respectively, in accordance with implementations.
Figure 23A:
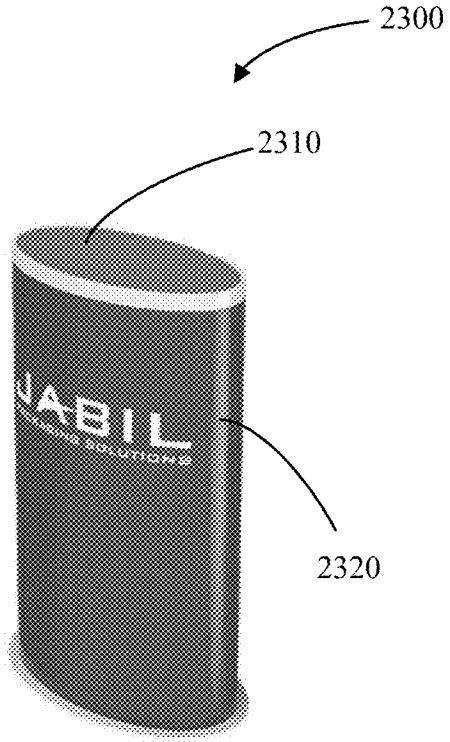

FIG. 23A and FIG. 23B are diagrams of a fusion package 2300 in a closed position and an open position, respectively, in accordance with implementations. The fusion package 2300 includes a cap 2310 and a package body 2320. The cap 2310 includes an opening 2312 for dispensing the content or material contained in the fusion package 2300. For example, the package body 2320 can be squeezed to cause expulsion of the content or material via the opening 2312.

Figure 24:
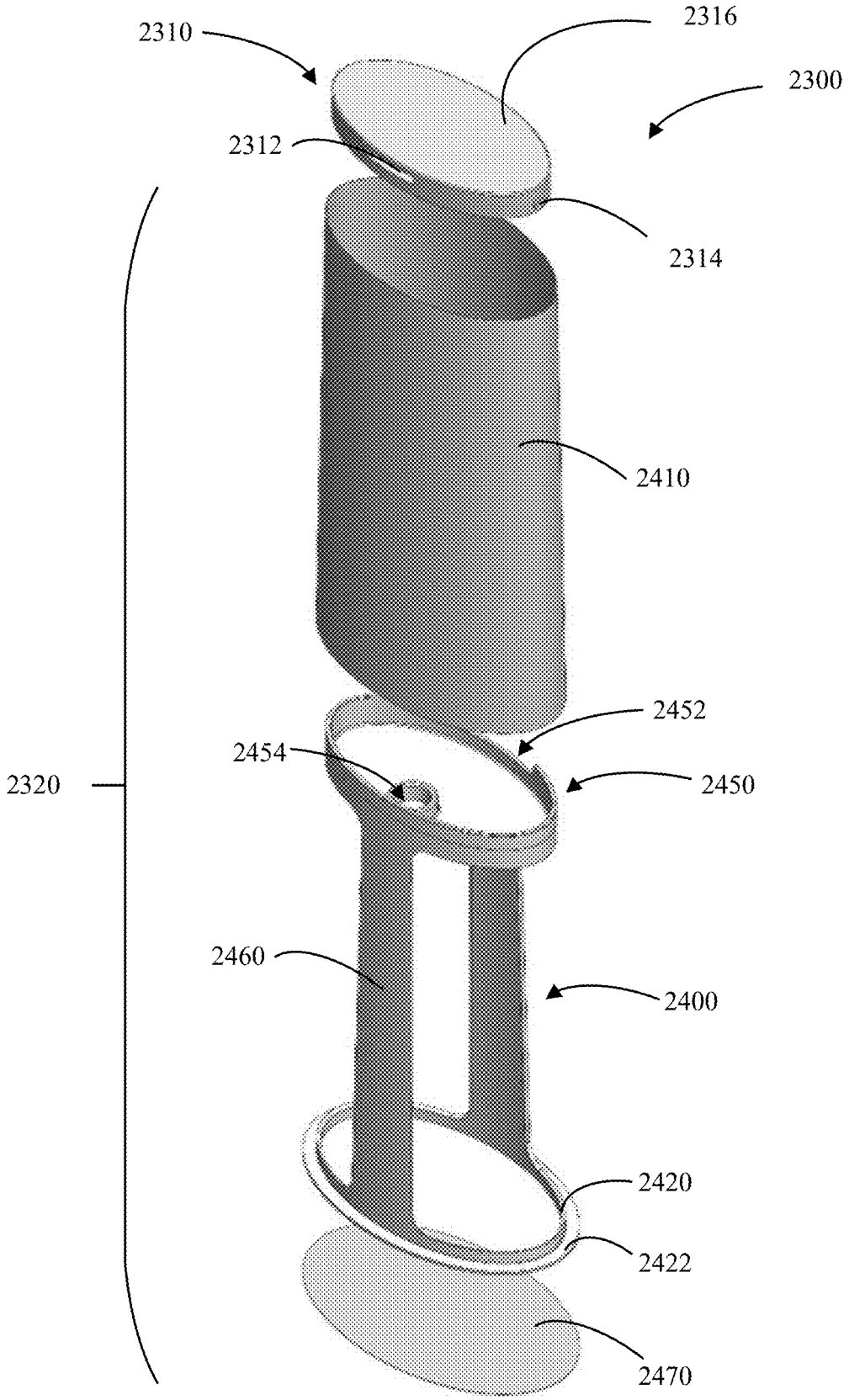
FIG. 24 is an exploded view of the fusion package of FIG. 23A in accordance with implementations.

FIG. 24 is an exploded view of the fusion package 2300 of FIG. 23A in accordance with implementations. The package body 2320 includes a frame 2400 and a sidewall 2410. The frame 2400 includes a bottom 2420, a neck 2450, and a pair of legs 2460 for connecting the bottom 2420 and the neck 2450. The bottom 2420 includes a flange 2422. The neck 2450 includes an opening 2452 and a ring structure 2454 extending into an internal portion of the frame 2400. A seal 2470 is configured to engage the flange 2422 when closing the fusion package 2300. In implementations, the sidewall 2410 can be made from heavy film, paperboard, pressed pulp, and the like materials as described herein. In implementations, the sidewall 2410 can include a barrier layer or film on an internal or inside surface. In implementations, the sidewall 2410 can include an integrated barrier layer, film, and/or material. In implementations, the frame 2400 can be made using the structure forming processes described herein using the materials described herein.

The cap 2310 includes an opening 2312 and a pair of pivot arms 2314 on opposite ends of the cap 2310. The pivot arms 2314 are configured to engage a mating structure on an internal surface of the neck 2450. The cap 2310 can pivot between a closed position as shown in FIG. 23A and a closed position as shown in FIG. 23B by pressing the cap 2310 at a spot 2316 which is proximate the opening 2452.

The fusion package 100 uses the join processing to fuse the sidewall 2410 with the frame 2400. The cap 2310 is snapped into place on the frame 2400. The fusion package 100 is filled from a bottom and then the seal 2470 is fused to the flange 2422. The fusion package 2300 is opened by pushing on the spit 2316 of the cap 2310. This enables content to be disposed via the ring 2454 and the opening 2312.

Figure 26:
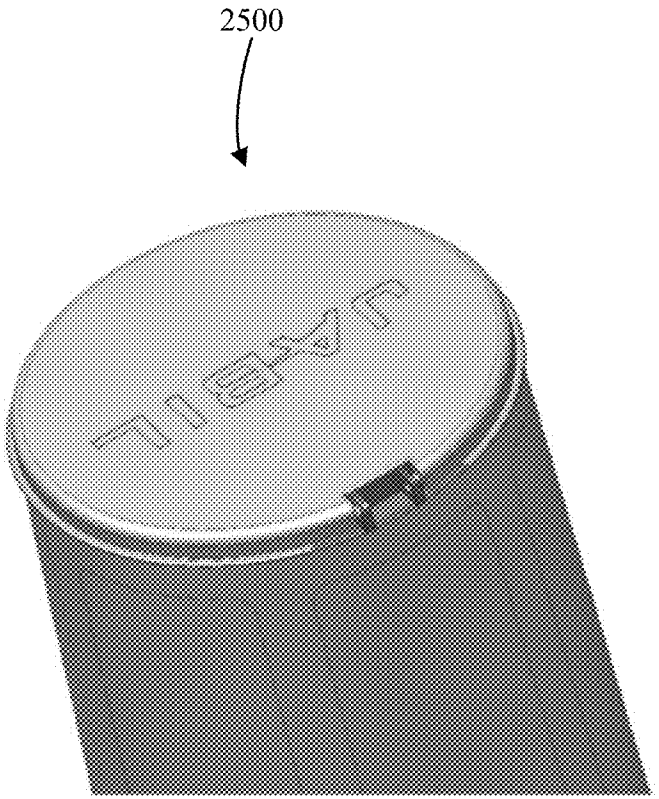
FIG. 26 is a reverse view of the fusion package of FIG. 25 in accordance with implementations.
Figure 25:
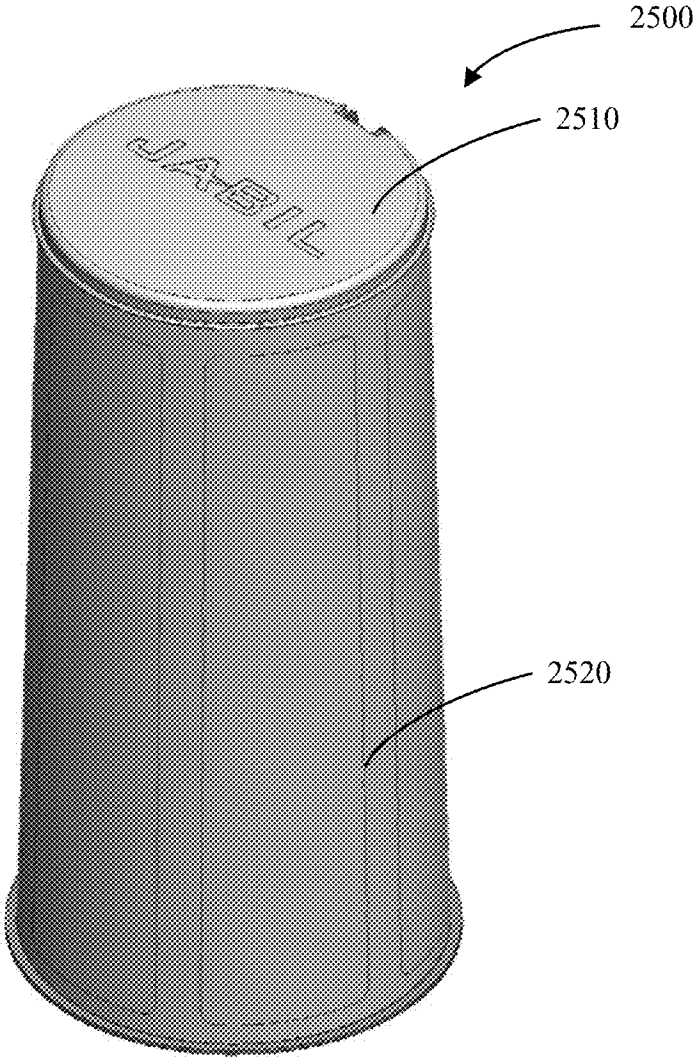
FIG. 25 is a diagram of a fusion package in a closed position in accordance with implementations.

FIG. 25 is a diagram of a fusion package 2500 in a closed position in accordance with implementations. FIG. 26 is a reverse view of the fusion package 2500 in accordance with implementations. The fusion package 2500 includes a cap 2510 and a package body 2520. The cap 2510 and the package body 2520 include a hinge mechanism to hingedly connect the cap 2510 and the package body 2520 so that the cap 2510 can be opened and closed as needed.

Figure 27:
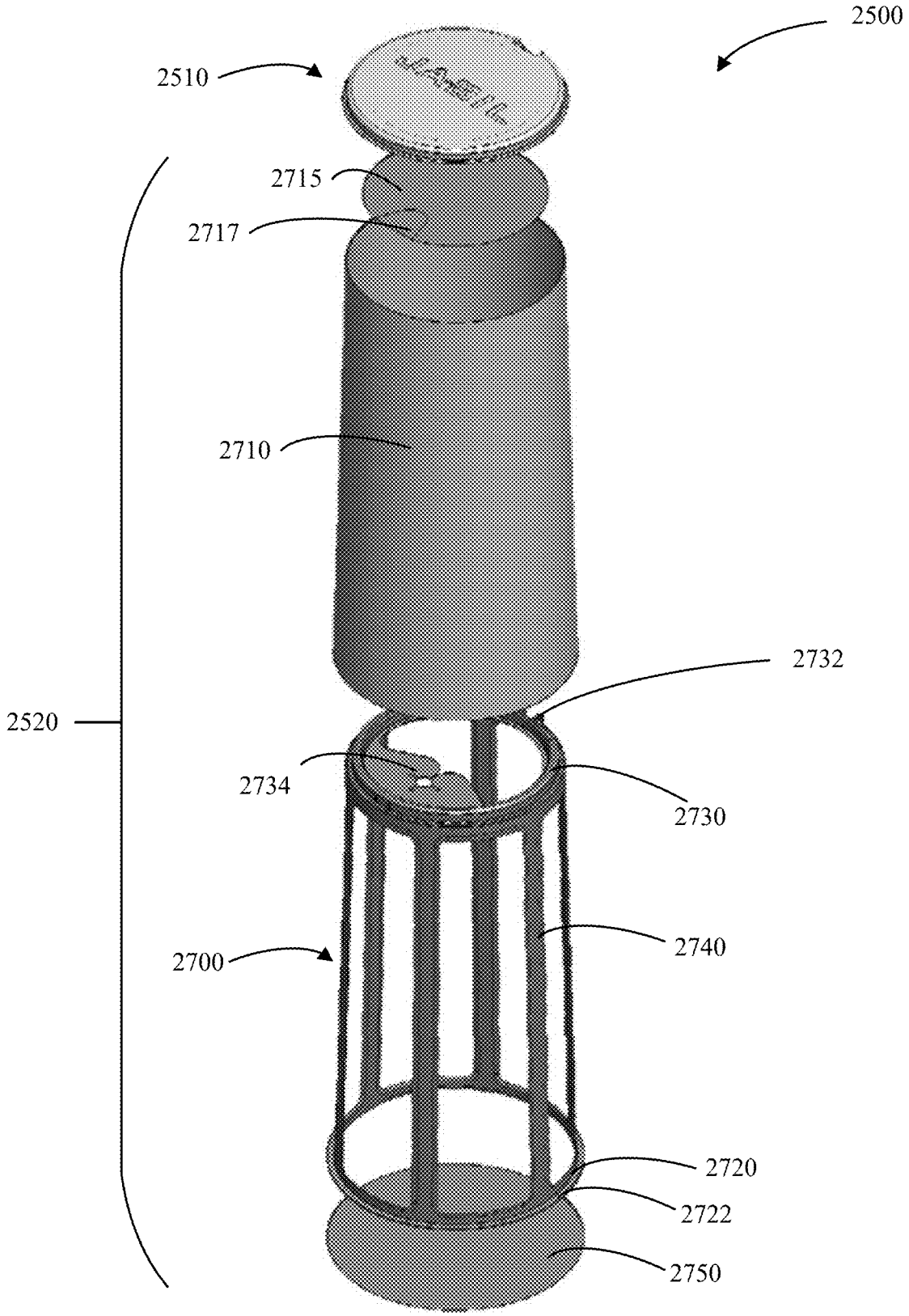
FIG. 27 is an exploded view of the fusion package of FIG. 25 in accordance with implementations.
Figure 28:
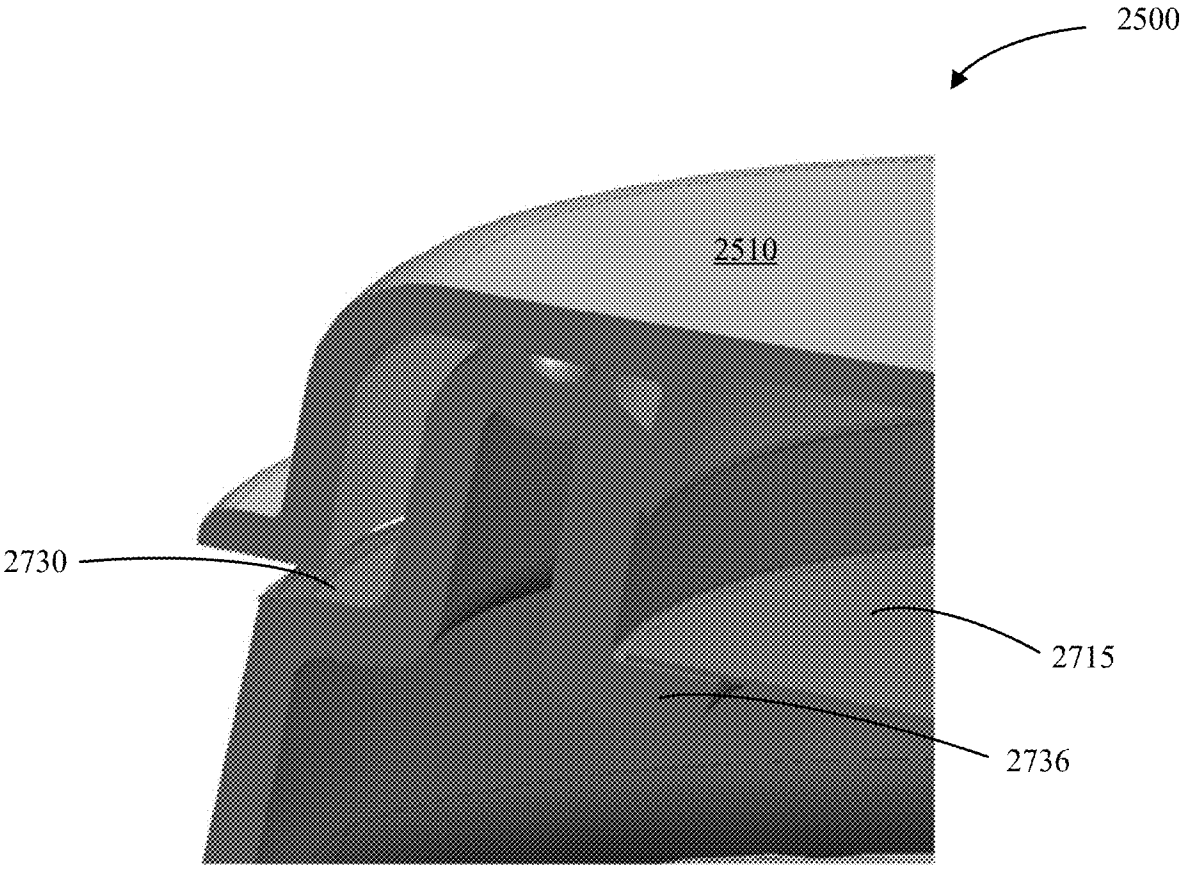
FIG. 28 is a cross-sectional view of the fusion package of FIG. 25 in accordance with implementations.

FIG. 27 is an exploded view of the fusion package 2500 in accordance with implementations. FIG. 28 is a cross-sectional view of the fusion package 2500 in accordance with implementations. The package body 2520 includes a frame 2700, a sidewall 2710, and a dispensing seal 2715. The frame 2700 includes a bottom 2720, a neck 2730, and legs 2740 for connecting the bottom 2720 and the neck 2730. The bottom 2720 includes a flange 2722. The neck 2730 includes a hinge mechanism 2732 and a dispensing structure 2734 extending into (e.g., inward towards) an internal portion of the frame 2500. In implementations, the dispensing structure 2734 is configured to hold and guide tissues, wipes, and the like out of the fusion package 2500. In implementations, the dispensing structure 2734 is a flexible structure that includes (e.g., defines) an opening 2900 connected to leaf openings 2910. A seal 2750 is configured to engage the flange 2722 when closing the fusion package 2700. The dispensing seal 2715 includes a perforated portion 2717 to permit access to the content.

In implementations, the sidewall 2710 can be made from heavy film, paperboard, pressed pulp, and the like materials as described herein. In implementations, the sidewall 2710 can include a barrier layer or film on an internal or inside surface. In implementations, the sidewall 2710 can include an integrated barrier layer, film, and/or material. In implementations, the frame 2700 can be made using the structure forming processes described herein using the materials described herein.

Figure 29:
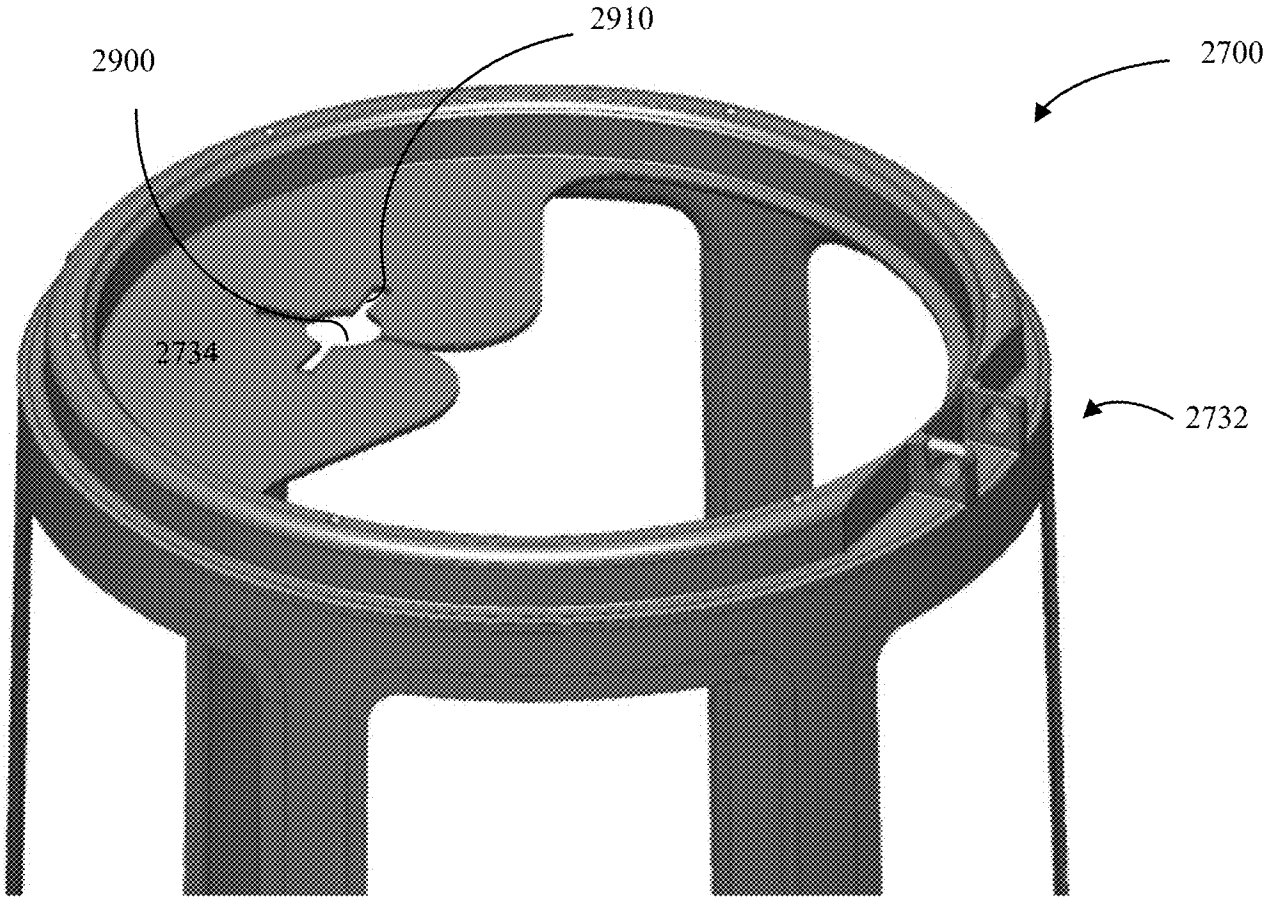
FIG. 29 is an enlarged view of the frame of FIG. 27 in accordance with implementations.
Figure 30:
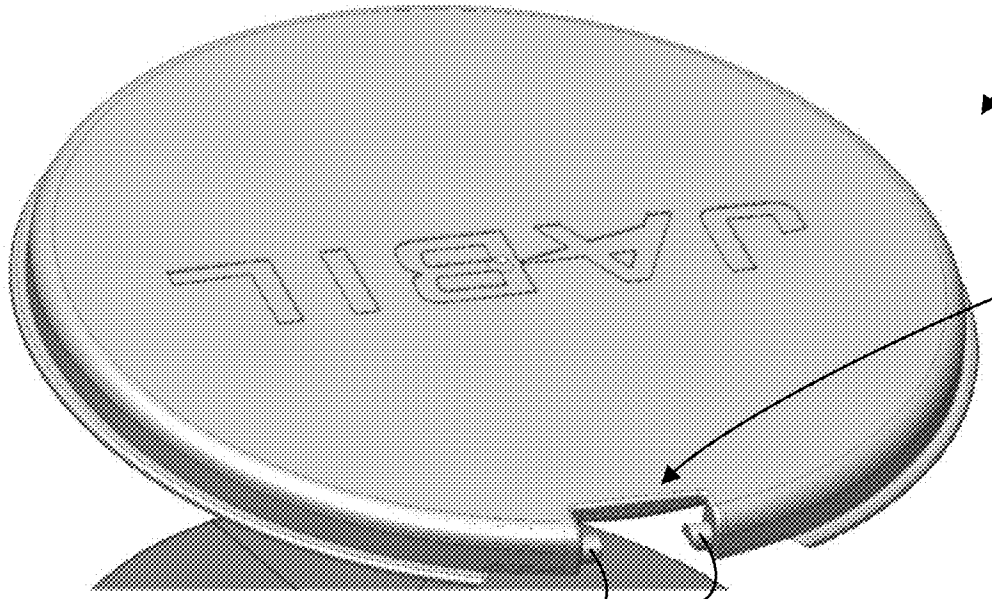
FIG. 30 is a perspective view of the lid of FIG. 25 in accordance with implementations.
Figure 31:
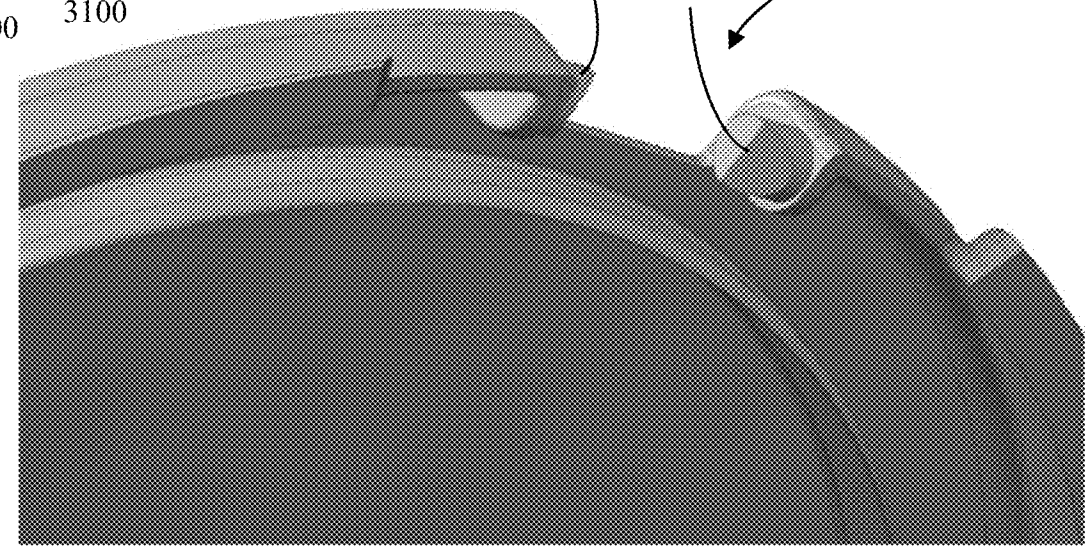
FIG. 31 is a reverse perspective view of the lid of FIG. 25 in accordance with implementations.

FIG. 29 is an enlarged view of the frame 2700 in accordance with implementations. FIG. 30 is a perspective view of the cap 2510 in accordance with implementations. FIG. 31 is a reverse perspective view the cap 2510 in accordance with implementations. The cap 2510 includes a hinge mechanism 3000 which is a pair of arms 3100. As noted, the neck 2730 includes a hinge mechanism 2732. The hinge mechanism 2732 is a pair of holes 2900 for coupling with the pair of arms 3100.

Figure 32:
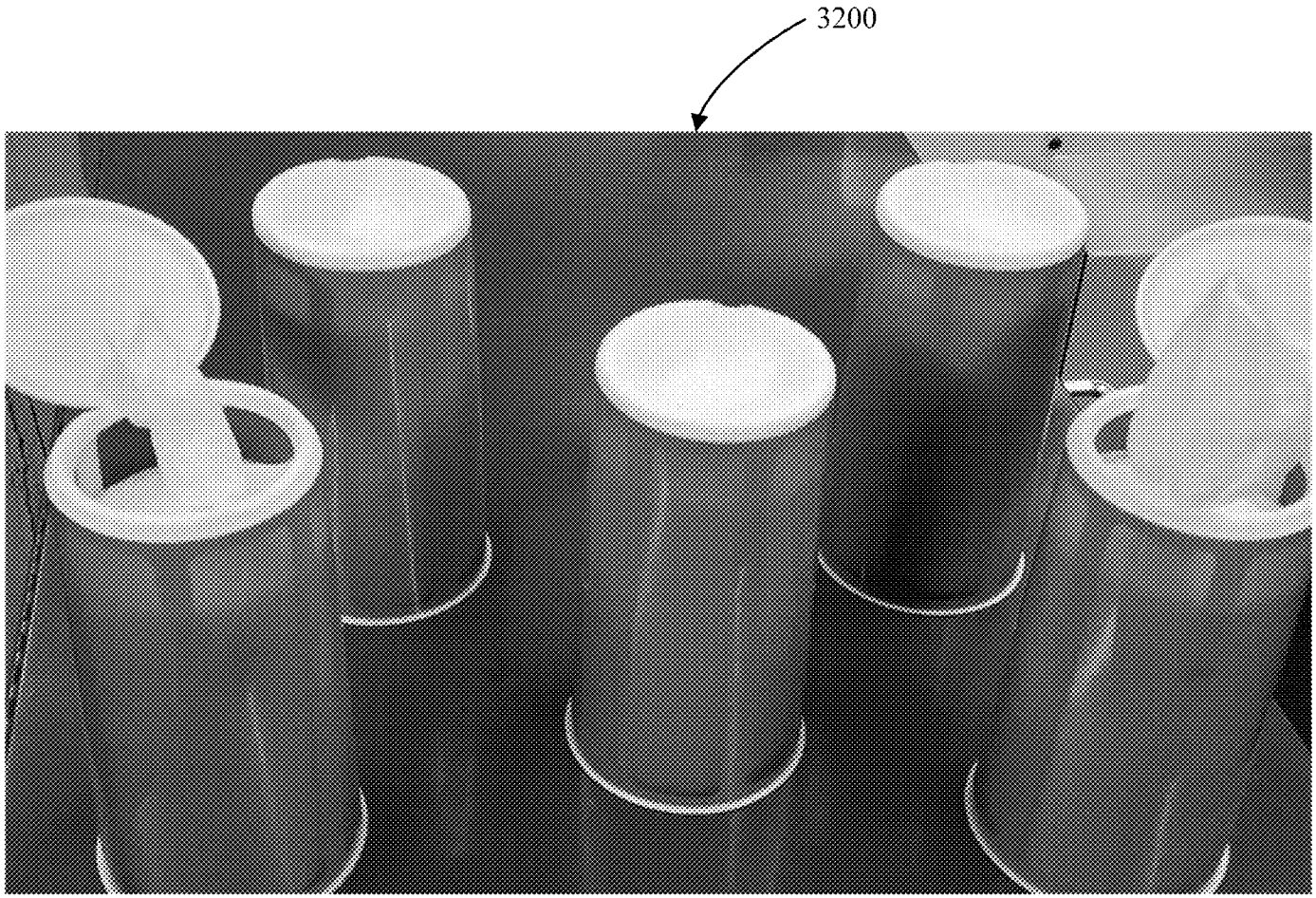
FIG. 32 are photos of example fusion packages of FIG. 25 in accordance with implementations.
Figure 34:
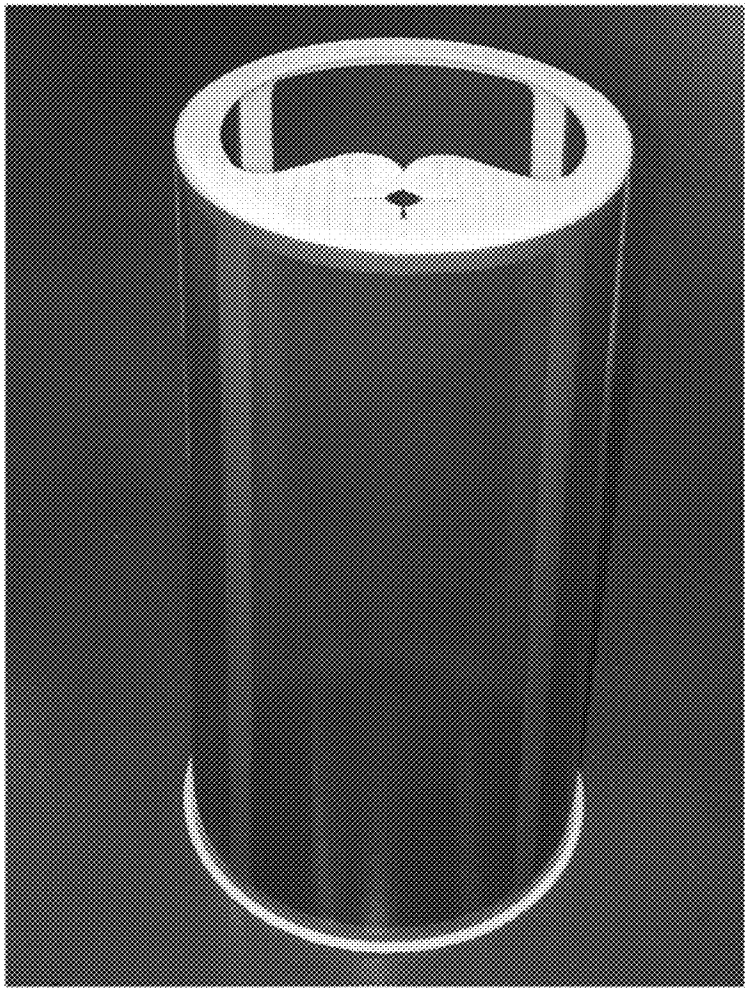
FIG. 34 is a photo of an example frame with sidewall of FIG. 27 in accordance with implementations.
Figure 33:
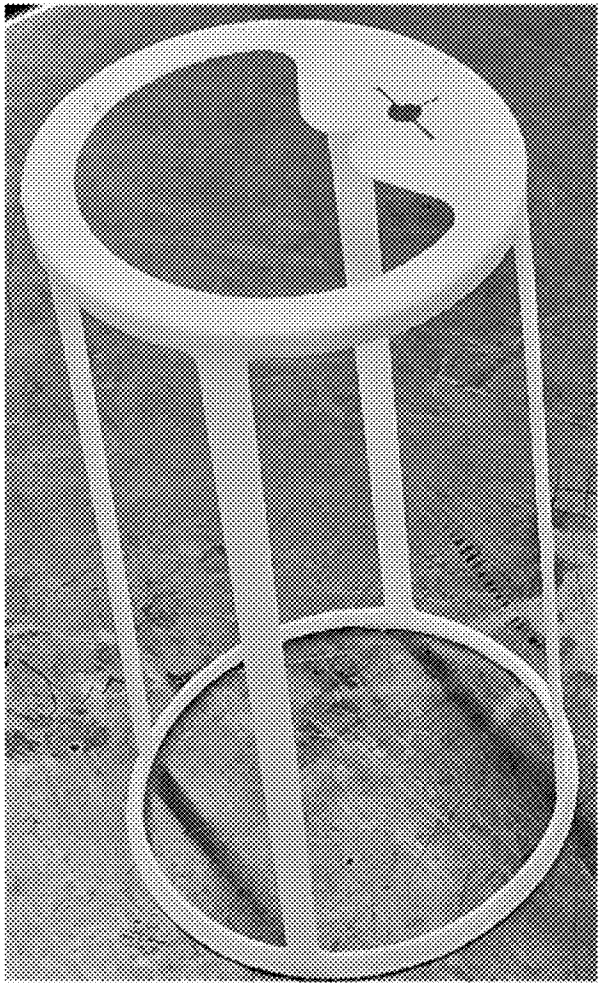
FIG. 33 is a photo of an example frame of FIG. 27 in accordance with implementations.

FIG. 32 are photos 3200 of example of the fusion packages 2500 in accordance with implementations. The photos 3200 show fusion packages 2500 which include content, such as tissue, which can be pulled from the fusion package 2500. The cap, frame, and sidewall are shown. FIG. 33 is a photo 3300 of an example frame 2700 in accordance with implementations. The photo 3300 shows a frame 2700 with four legs. FIG. 34 is a photo 3400 of an example frame 2700 with sidewall 2710 in accordance with implementations.

The fusion package 100 uses the join processing to fuse the sidewall 2710 with the frame 2700 and the dispensing seal 2715 to a flange 2736 of the neck 2730. The cap 2510 is snapped into place on the frame 2700. The fusion package 2700 is filled from a bottom and then the seal 2750 is fused to the flange 2722. The fusion package 2700 is opened by opening the cap 2510. The perforated portion 2717 is removed to obtain access to the content. The cap 2510 can be closed after obtaining the content.

Figure 35B:
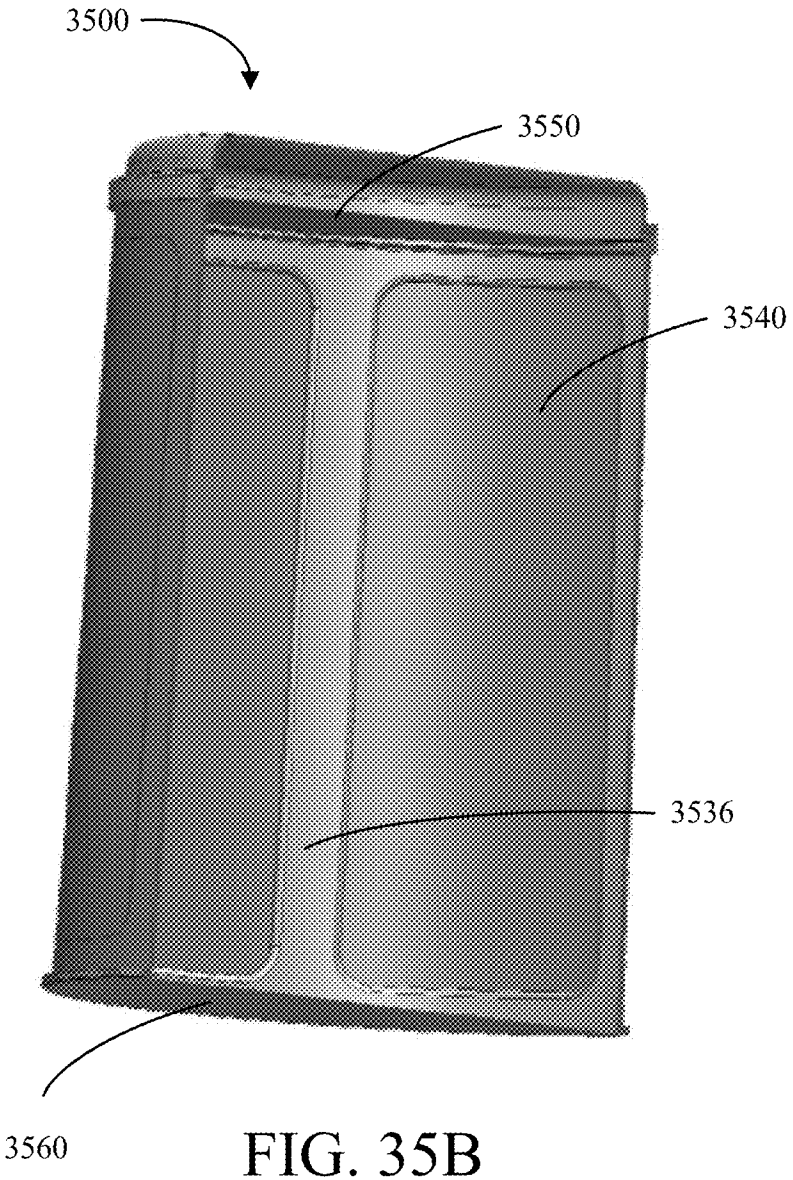
FIG. 35B is a cross-sectional view of the fusion package of FIG. 35A in accordance with implementations.
Figure 35A:
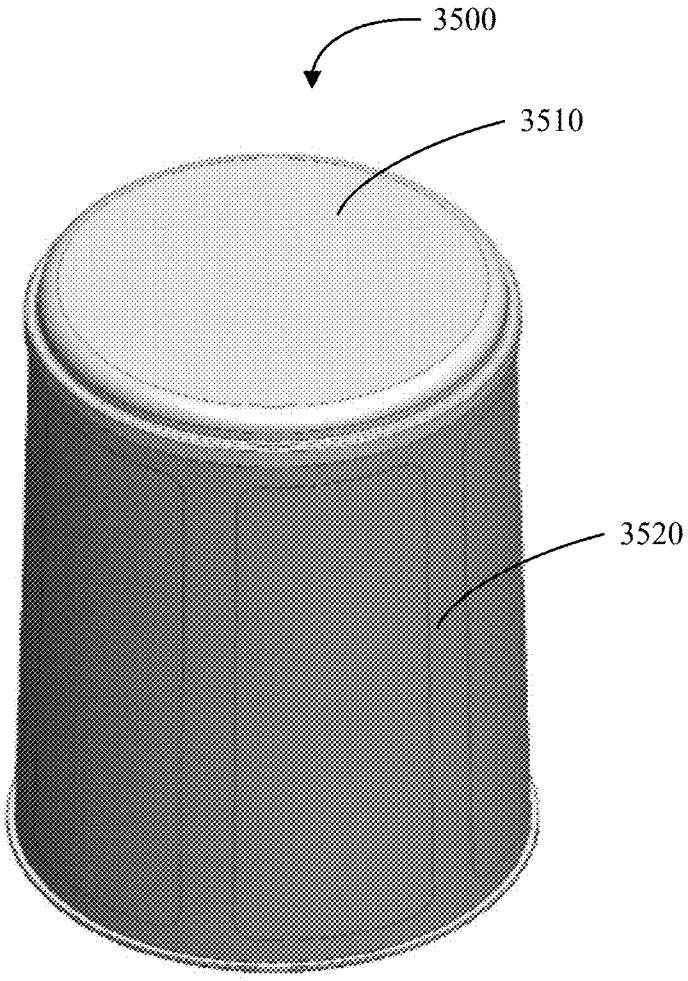
FIG. 35A is a diagram of a fusion package in a closed position in accordance with implementations.
Figure 35C:
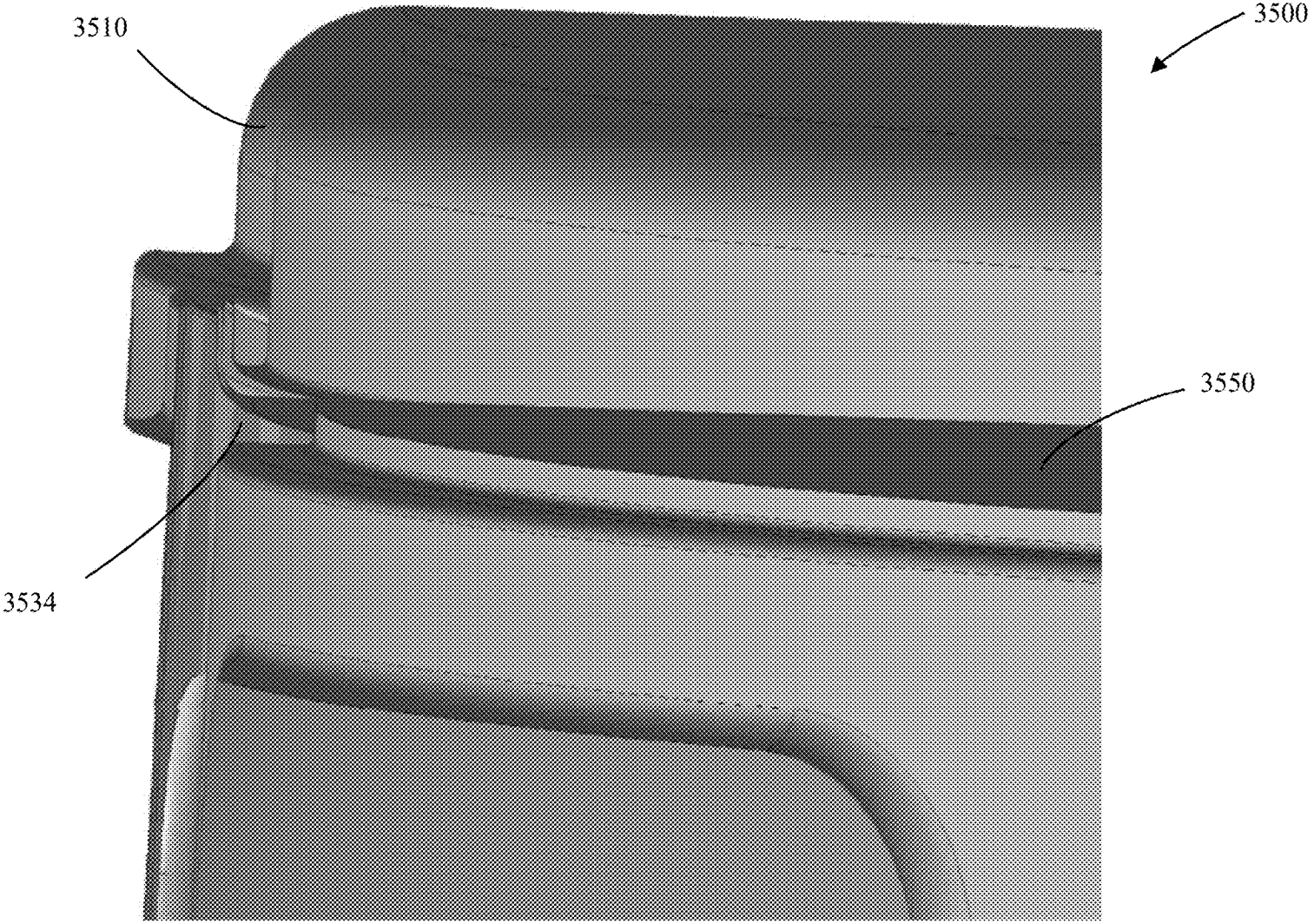
FIG. 35C is an enlarged cross-sectional view of the fusion package of FIG. 35A in accordance with implementations.
Figure 36:
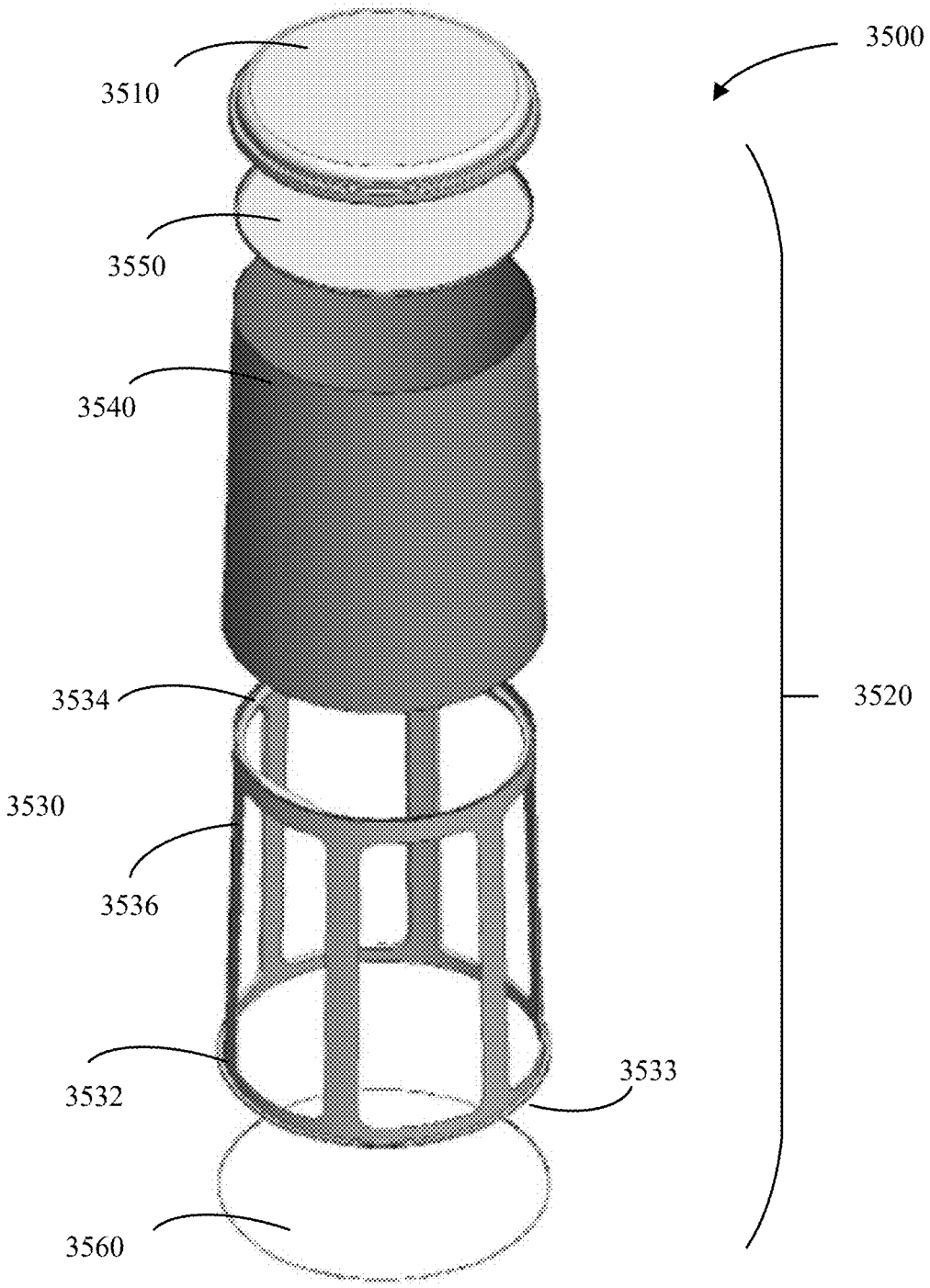
FIG. 36 is an exploded view of a fusion package in accordance with implementations.
Figure 37:
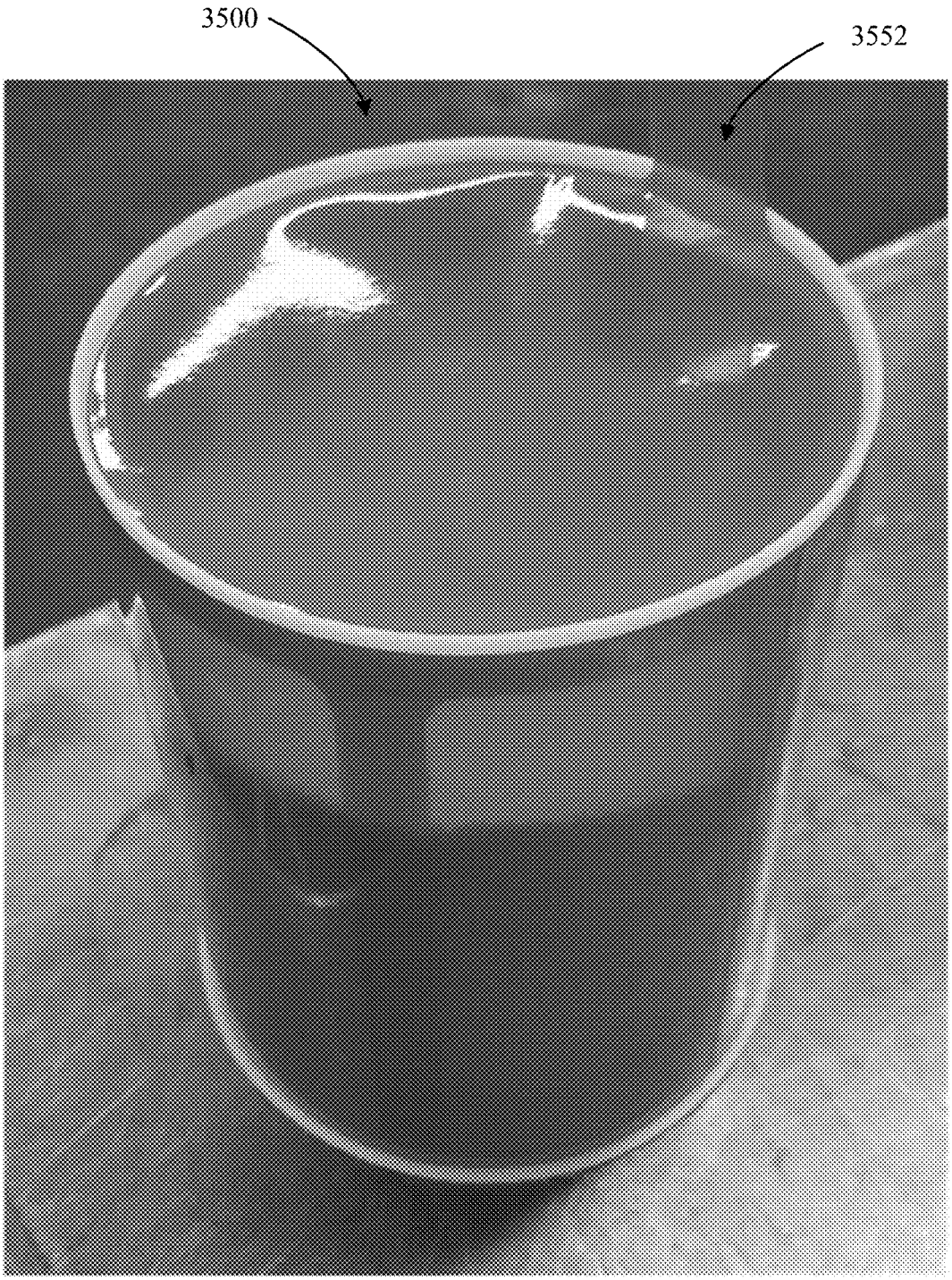
FIG. 37 is a photo of an example frame with sidewall of FIG. 35A in accordance with implementations.

FIG. 35A is a diagram of a fusion package 3500 in a closed position in accordance with implementations. FIG. 35B is a cross-sectional view of the fusion package of FIG. 35A in accordance with implementations. FIG. 35C is an enlarged cross-sectional view of the fusion package of FIG. 35A in accordance with implementations. The fusion package 3500 includes a cap 3510 and a package body 3520. FIG. 36 is an exploded view of the fusion package 3500 in accordance with implementations. FIG. 37 is a photo of an example frame with sidewall of FIG. 35A in accordance with implementations.

The package body 3520 includes a frame 3530, a sidewall 3540, a peelable seal 3550, and a seal 3560. The frame 3530 includes a bottom 3532, a neck 3534, and legs 3536 for connecting the bottom 3532 and the neck 3534. The bottom 3532 includes a flange 3533. The seal 3560 is configured to engage the flange 3533 when closing the fusion package 3500. The peelable seal 3550 includes a tab 3552 to remove the peelable seal 3550 and permit access to the content. In implementations, the sidewall 3540 can be made from heavy film, paperboard, pressed pulp, and the like materials as described herein. In implementations, the sidewall 3540 can include a barrier layer or film on an internal or inside surface. In implementations, the sidewall 3540 can include an integrated barrier layer, film, and/or material. In implementations, the frame 3530 can be made using the structure forming processes described herein using the materials described herein.

The fusion package 100 uses the join processing to fuse the sidewall 3540 with the frame 3530 and the peelable seal 3550 to the neck 3534. The cap 3510 is snapped into place on the neck 3534 of the frame 3530. The fusion package 3500 is filled from a bottom and then the seal 3560 is fused to the flange 3533 after filling is complete. The fusion package 3500 is opened by opening the cap 3510. The peelable seal 3550 is removed by pulling on the tab 3552 to obtain access to the content. The cap 3510 can be closed after obtaining the content.

Figure 38:
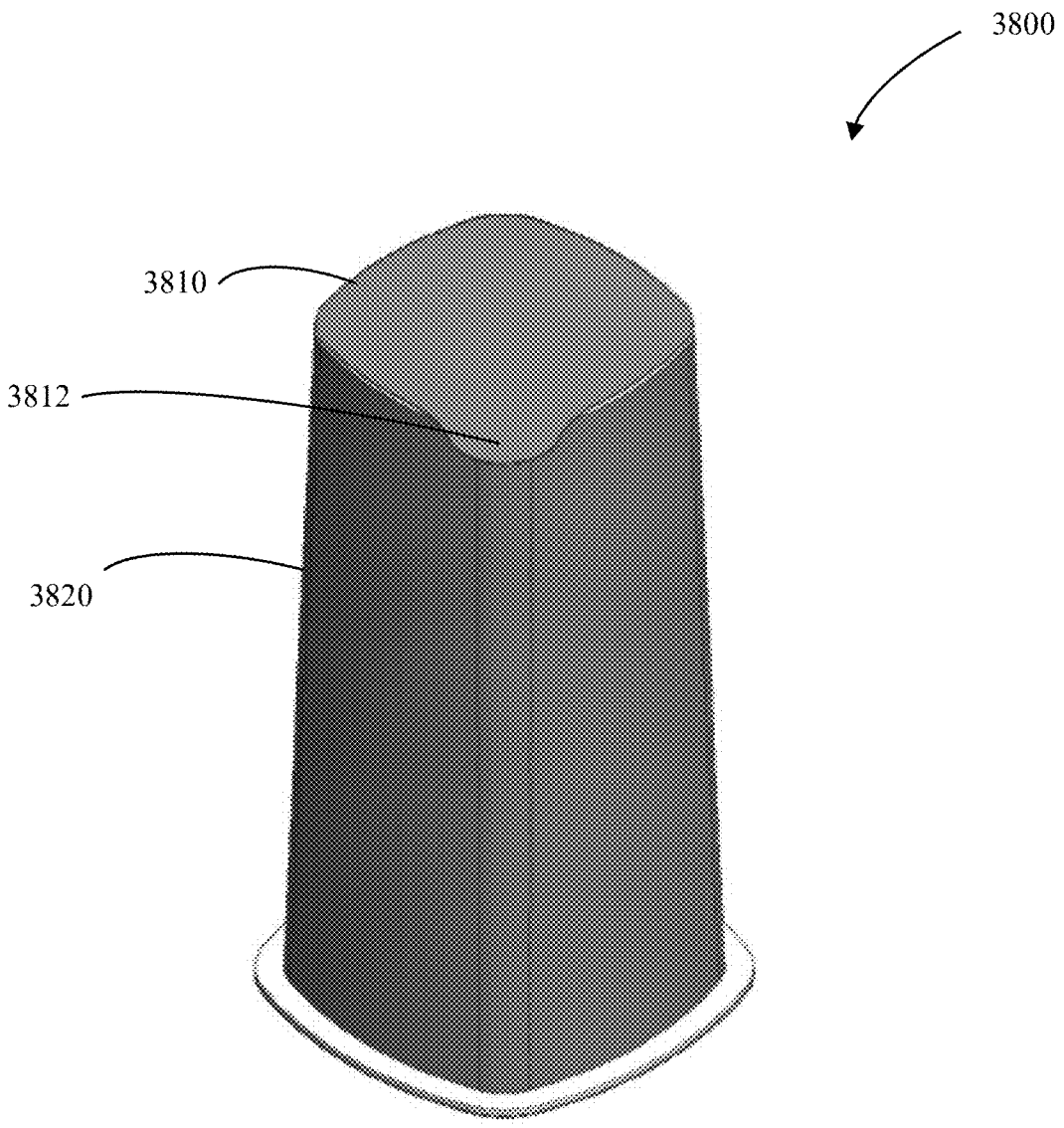
FIG. 38 is a diagram of a fusion package in a closed position in accordance with implementations.
Figure 39:
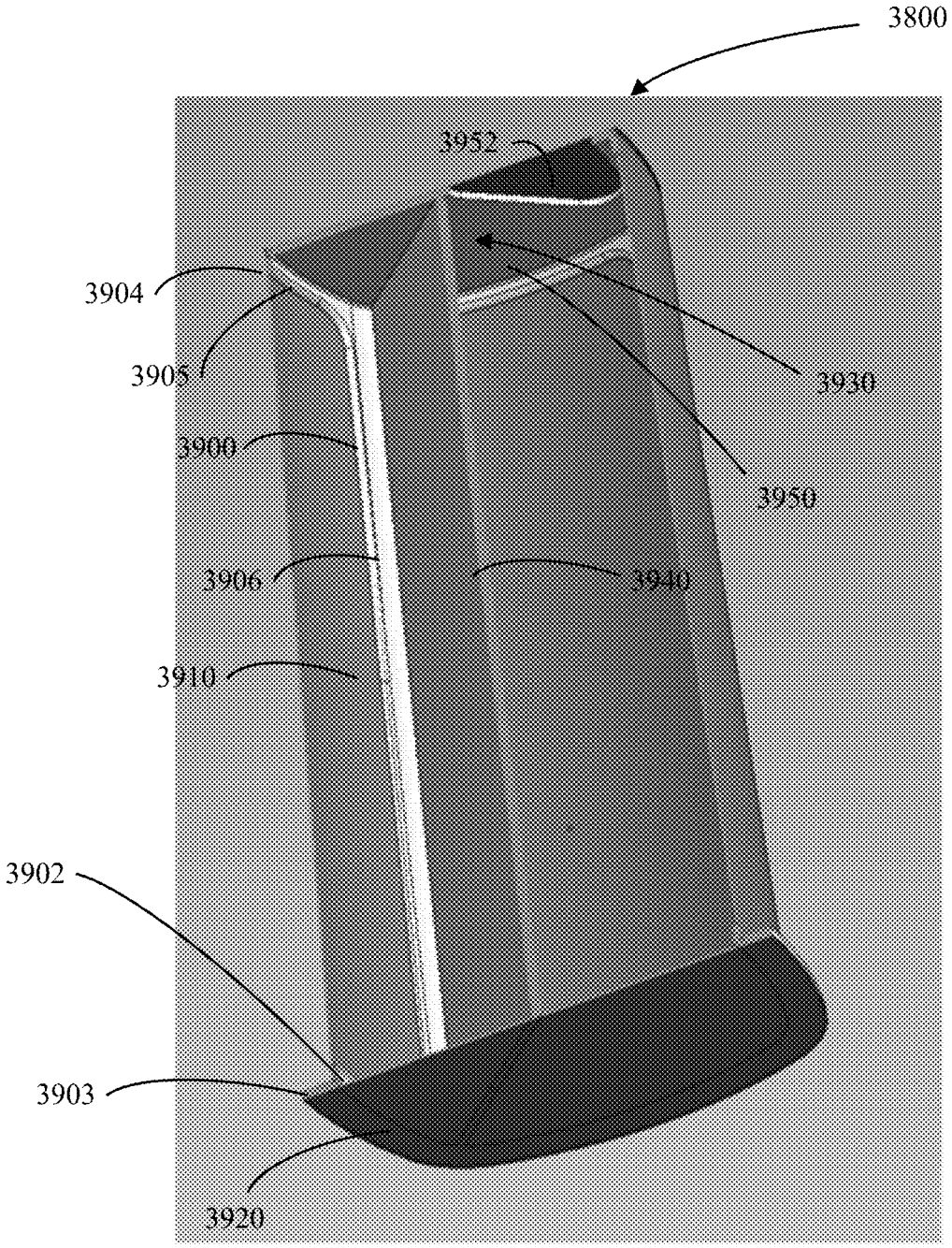
FIG. 39 is a cross-sectional view of the fusion package of FIG. 38 in accordance with implementations.

FIG. 38 is a diagram of a fusion package 3800 in a closed position in accordance with implementations. FIG. 39 is a cross-sectional view of the fusion package 3800 in accordance with implementations.

The fusion package 3800 includes a peelable seal 3810 and a package body 3820. The peelable seal 3810 includes a pull tab 3812. The package body 3820 includes a frame 3900, a sidewall 3910, a seal 3920, and a divider structure 3930. The frame 3900 includes a bottom 3902, a neck 3904, and legs 3906. The legs 3906 connect the bottom 3902 and the neck 3904. The bottom 3902 includes a flange 3903 for fusing with the seal 3920. The neck 3904 includes a rim 3905. The divider structure 3930 divides the fusion package 3800 into two sections separated (e.g., spaced apart) by the divider structure 3930. The divider structure 3930 includes a compartment divider 3940 and an access divider 3950. The compartment divider 3940 is connected or fused to two opposite (e.g., opposing) legs of the legs 3906 of the frame 3900. The access divider 3950 is connected or fused to the rim 3905. The access divider 3950 includes a first access opening 3952 and a second access opening (only the first access opening 3952 is shown). In implementations, the frame 3900 and the divider structure 3930 can be an integrated structure. In implementations, the sidewall 3910 can be made from heavy film, paperboard, pressed pulp, and the like materials as described herein. In implementations, the sidewall 3910 can include a barrier layer or film on an internal or inside surface. In implementations, the sidewall 3910 can include an integrated barrier layer, film, and/or material. In implementations, the frame 3900 can be made using the structure forming processes described herein using the materials described herein.

The fusion package 100 uses the join processing to fuse the sidewall 3910 to the frame 3900 (e.g., to at least partially enclose the compartment defined by the package body 3820) and the peelable seal 3810 to the frame 3900 and/or the divider structure 3930, as appropriate. The fusion package 3800 is filled from a bottom and then the seal 3920 is fused to the flange 3903. In implementations, fusing of the seal 3920 can be done at a content or material production site. That is, a non-sealed fusion package 3800 can be shipped to a manufacturer of the material, who can then fill and seal the fusion package 3800. The fusion package 3800 is opened by peeling the peelable seal 3810 using the tab 3812.

Figure 40B:
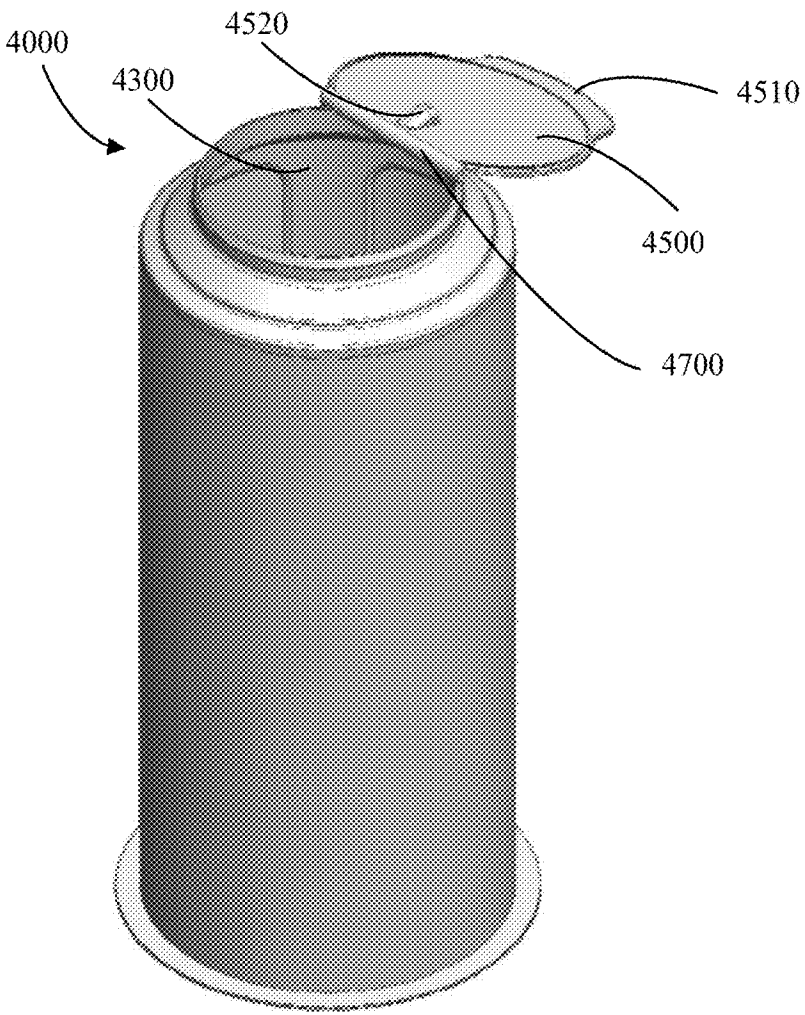
FIG. 40A, FIG. 40B, and FIG. 40C are diagrams of a fusion package in a closed position and an open position, respectively, in accordance with implementations.
Figure 40A:
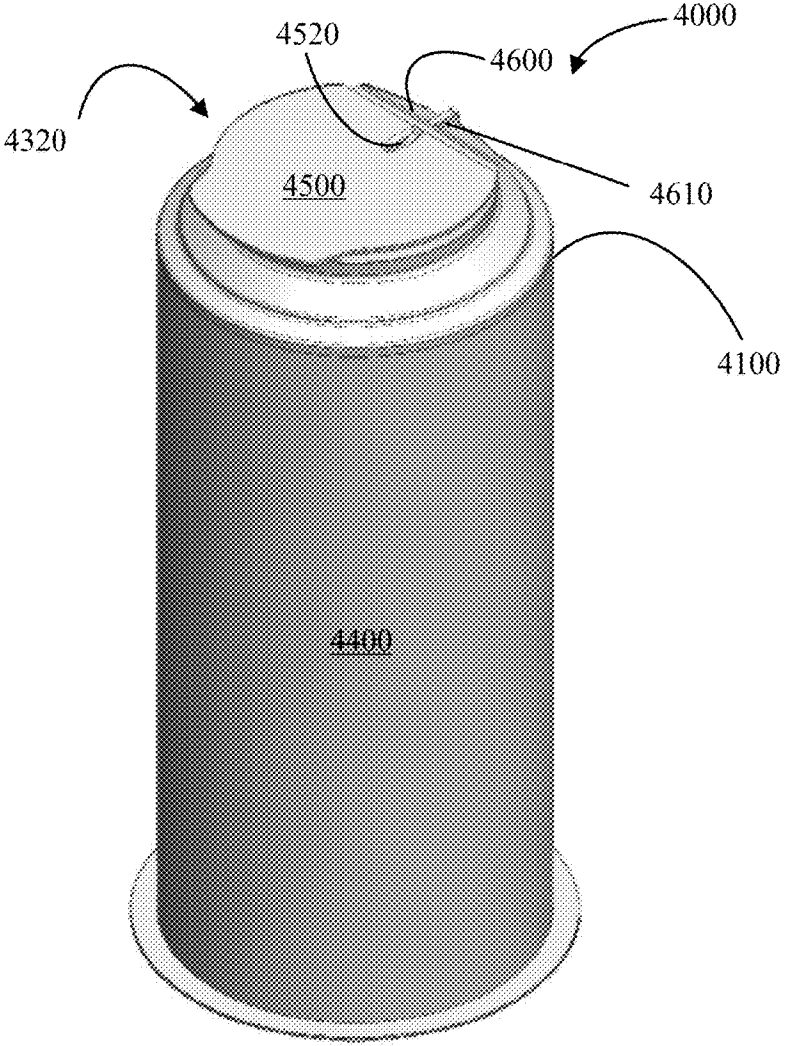
Figure 40C:
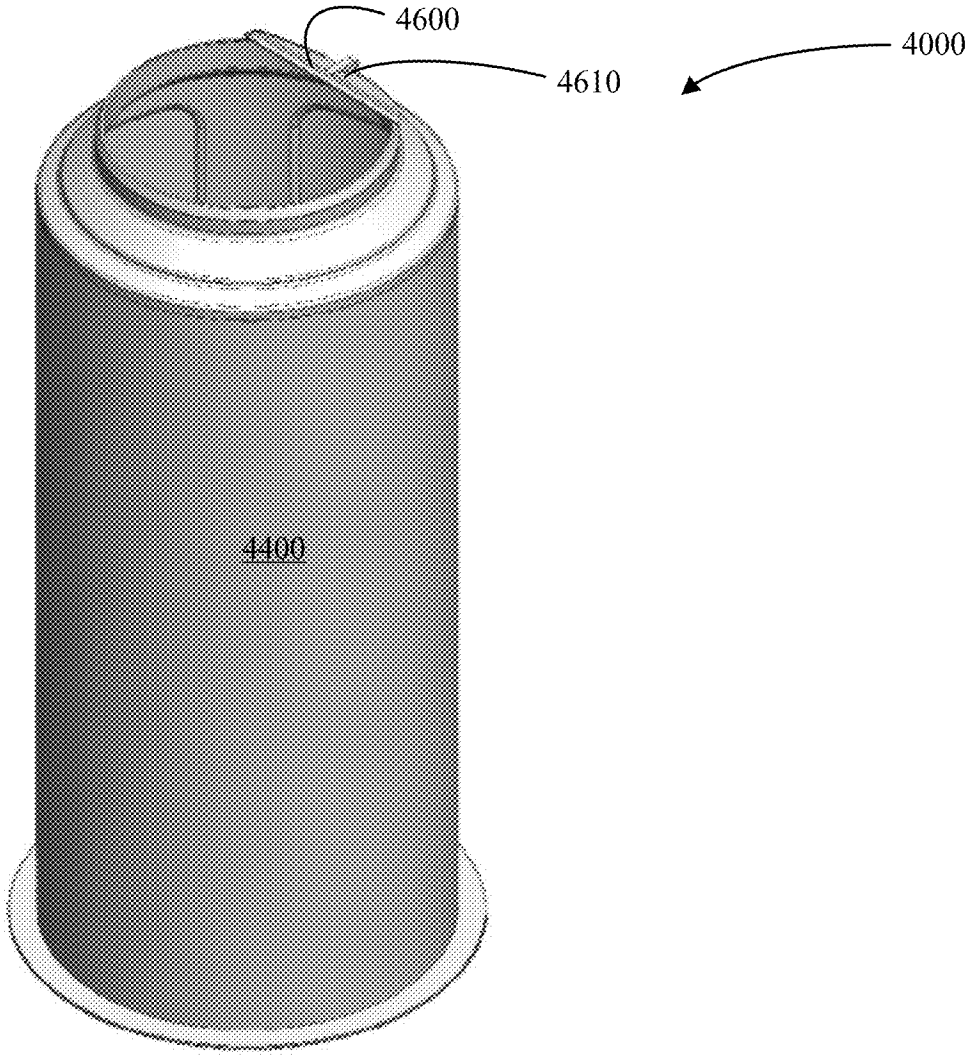
Figure 41:
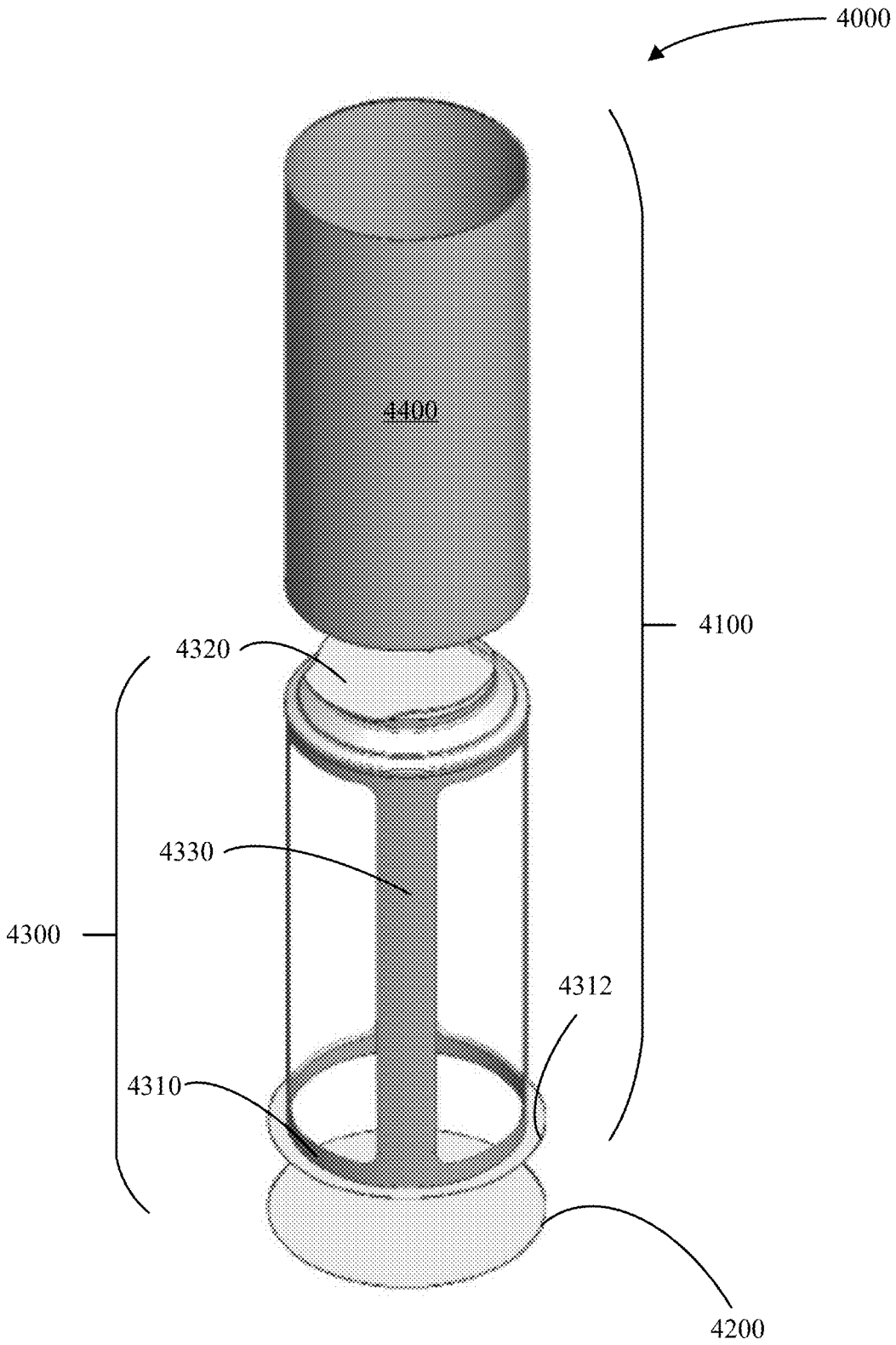
FIG. 41 is an exploded view of the fusion package of FIG. 40A in accordance with implementations.

FIG. 40A, FIG. 40B, and FIG. 40C are diagrams of a fusion package 4000 in a closed position, an open position, and with a peelable seal removed, respectively, in accordance with implementations. FIG. 41 is an exploded view of the fusion package 4000 of FIG. 40A in accordance with implementations. The fusion package 4000 includes an integrated package body 4100 and a seal 4200. The integrated package body 4100 includes a frame 4300 and a sidewall 4400. In implementations, the sidewall 4400 can be made from heavy film, paperboard, pressed pulp, and the like materials as described herein. In implementations, the sidewall 4400 can include a barrier layer or film on an internal or inside surface. In implementations, the sidewall 4400 can include an integrated barrier layer, film, and/or material. In implementations, the frame 4300 can be made using the structure forming processes described herein using the materials described herein.

The frame 4300 includes a bottom 4310, a cap portion 4320, and legs 4330 for connecting the bottom 4310 and the cap portion 4320. The bottom 4310 includes a flange 4312. The seal 4200 is configured to engage the flange 4312 when closing or sealing the fusion package 4000. The cap portion 4320 includes a peel portion 4500, a retain portion 4600, and a hinge portion 4700. The peel portion 4500 has a tab portion 4510 and a retain groove 4520. The retain portion 4600 includes a retain projection 4610 for engagement with the retain groove 4520. The hinge portion 4700 flexibly or hingedly connects the peel portion 4500 and the retain portion 4600. In implementations, the cap portion 4320 is a peel portion only which can be removed for access to the content.

The fusion package 4000 uses the join processing to fuse the frame 4300 with the sidewall 4400. The fusion package 4000 is filled from a bottom and then the seal 4200 is fused to the flange 4312 using the join processing processes. In implementations, fusing of the seal 4200 can be done at a content or material production site. That is, a non-sealed fusion package 4000 can be shipped to a manufacturer of the material, who can then fill and seal the fusion package 4000. The fusion package 4000 is opened by pulling up on the tab portion 4510 to peel the peel portion 4500 away from the frame 4300 until hitting the hinge portion 4700, which prevents environmental disposal issues and enables sustainability. In implementations, the retain projection 4610 can engage the retain groove 4520 to keep peel portion 4500 from interfering in accessing the content or material in the fusion package 4000. In implementations, the peel portion 4500 can be torn away at the hinge portion 4700 with only the retain portion 4600 remaining as shown in FIG. 40C.

The construction and arrangement of the methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials and components, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps, and decision steps.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A package comprising:
- a cap;
- a frame that includes:
  - legs having openings between the legs and configured to provide structure for the package; and
  - a neck located at a first end of the frame and formed with the frame, wherein the neck includes:
    - a hinge mechanism that hingedly connects the cap to the first end of the frame; and
    - a dispensing structure extending from the frame into an internal portion of the frame, wherein the dispensing structure is configured to hold and guide contents positioned in the package out of the package, and wherein the dispensing structure is a flexible structure that includes an opening connected to leaf openings;

a sleeve fused to a surface of the frame to close the frame;

a dispensing seal positioned between the cap and the dispensing structure of the frame, wherein the neck includes a flange that extends inward into the internal portion of the frame, the dispensing seal is fused to the flange of the neck, and the dispensing seal includes a perforated portion that is configured to permit access to content within the package when the cap is in an open position; and a seal configured to be fused to a second end of the frame after the package is filled with content, wherein the second end of the frame includes a second flange and the seal is configured to be fused to a surface of the second flange.

2. The package of claim 1, wherein the cap includes a pair of pivot arms configured to engage a mating structure on the frame to pivot from an open position to a closed position.

3. The package of claim 2, wherein the dispensing structure is positioned below the perforated portion and below the first end of the frame, the dispensing structure is formed with the flange of the neck, and wherein the dispensing structure is configured to present and hold the content for removal from the package through the opening and the leaf openings.

4. The package of claim 1, wherein the hinge mechanism includes a pair of arms positioned on the cap that are configured for coupling with a pair of holes positioned on the neck of the frame.

5. A package comprising:

a frame configured to provide structure for the package, wherein the frame includes:

a bottom having a flange;

a neck; and one or more legs connecting the bottom to the neck and positioned between the bottom and the neck;

a film fused to the frame such that a portion of the frame is contained within the film;

a cap connected to the neck of the frame, the cap including:

a tab element configured to provide access to content within the package, wherein the tab element extends beyond an outer peripheral edge of the cap, a tearable membrane portion configured to be peeled away by the tab element to open an opening to access the content, a tether mechanism configured to connect the tearable membrane portion to a remaining portion of the cap, wherein the tab element is configured to tear the tearable membrane portion such that the tearable membrane portion is peeled away from the cap to open the opening and remains connected to the remaining portion of the cap by the tether mechanism, and a tab element retainer configured to retain the tab element away from the opening; and a seal connected to a surface of the flange, wherein the flange of the bottom of the frame is located between the film and the seal, and wherein one of the cap and the seal are connected to the frame after the content is positioned in the package.

6. The package of claim 5, wherein the tether mechanism is a hinge portion that facilitates pivoting of the tab element with respect to the remaining portion of the cap.

7. A package comprising:

a frame configured to provide structure for the package, the frame including a rim that forms an opening to an internal portion of the package;

a cap that is integrally formed with the frame and that includes:

a peel portion that is configured to be peeled away from the frame, wherein the peel portion includes a tab portion that extends beyond the rim of the frame and a retaining groove formed along a surface of the peel portion, a retaining portion that includes a retaining projection located along an edge of the rim, and a hinge portion that flexibly connects the peel portion to the retaining portion, wherein the peel portion is configured to pivot to an open position by pivoting the peel portion with respect to the retaining portion about the hinge portion, and wherein the retaining groove is configured to engage the retaining projection in the retaining groove when the peel portion is in the open position to secure the peel portion in the open position;

a film fused to a surface of the frame; and a seal connected to one end of the frame after content is positioned in the package, wherein the tab portion is configured to peel the peel portion away from the frame such that the peel portion is pivoted to the open position and remains connected to the retaining portion by the hinge portion.

8. The package of claim 7, wherein the hinge portion is positioned between the retaining portion and the peel portion.

9. The package of claim 7, wherein the tab portion extends from the peel portion beyond an opening of the frame that permits access to the package.

10. The package of claim 7, wherein the frame includes a flange positioned at the one end of the frame, and wherein the seal is connected to the flange after the content is positioned in the package.

11. The package of claim 7, wherein the peel portion is configured to be positioned away from an opening of the cap when the peel portion is positioned in the open position.

12. A package comprising:

a frame that includes:

a bottom positioned at a first end of the frame, a neck positioned at a second end of the frame and that includes an opening and a ring structure extending into an internal portion of the frame, wherein the ring structure extends inward from the neck and is formed with the frame, and wherein content in the package is configured to be disposed via the ring structure, legs having openings between the legs and extending between the bottom and the neck to connect the bottom to the neck, and a flange formed with the bottom and projecting away from the bottom;

a bottom seal coupled to a bottom surface of the flange;

a sidewall coupled to a surface of the frame, wherein a first end of the sidewall is positioned on the flange such that the flange is located between the bottom seal and the sidewall; and a cap coupled to the frame and that includes pivot arms that are configured to engage a mating structure on an internal surface of the frame, wherein the cap is configured to pivot between an open position and a closed position about the pivot arms, and wherein the cap is configured to be contained within the sidewall when the cap is in the closed position.

13. The package of claim 12, wherein the cap includes a cap opening that is configured for dispensing a content positioned within the package, the cap opening is closed by the sidewall when the cap is in the closed position, and the cap opening is positioned above the sidewall when the cap is in the open position such that the cap opening is opened by the sidewall.

14. The package of claim 12, wherein a second end of the sidewall is positioned beneath the opening.

15. The package of claim 12, wherein the pivot arms are a pair of pivot arms that are positioned on opposite ends of the cap, and wherein the package is configured for squeezing for expulsion of content located within the package through the opening of the cap.

16. A package comprising:

a package body that defines a compartment and that includes:

a frame having:

a bottom that includes a flange extending inward from the flange;

a neck that includes a rim;

legs connecting the bottom to the neck; and a divider structure that includes:

a compartment divider that is positioned in the compartment and that divides the compartment into sections, wherein the compartment divider extends between, and is formed with, opposing ones of the legs; and and an access divider formed with the rim of the neck, wherein the access divider defines one or more openings to permit access to the compartment;

a sidewall fused to the legs of the frame to at least partially enclose the compartment; and a bottom seal fused to the flange to at least partially enclose the compartment; and a peelable seal that is fused to the rim and the divider structure, wherein the bottom seal includes a pull tab that is configured to peel the peelable seal away from the frame to permit access to the compartment.

17. The package of claim 16, wherein the compartment divider, the access divider, and the frame are integrated.

18. The package of claim 16, wherein the sidewall includes a barrier layer on an internal surface that faces the compartment.

19. The package of claim 16, wherein the access divider includes:

a first opening that permits access to a first section of the compartment; and a second opening that permits access to a second section of the compartment, the second section being separated from the first section by the compartment divider.

20. The package of claim 16, wherein the sidewall is spaced apart from the bottom seal by the bottom of the frame.

21. The package of claim 16, wherein one of the peelable seal or the bottom seal is configured for fusing to the frame after filling compartment with content.

* * * * *